US006405768B1

(12) United States Patent
McClaran

(10) Patent No.: US 6,405,768 B1
(45) Date of Patent: Jun. 18, 2002

(54) PRESSURE FUEL SERVICING NOZZLE

(75) Inventor: Mark Randall McClaran, Orange, CA (US)

(73) Assignee: Cla-Val Co., Costa Mesa, CA (US)

( * ) Notice: Subject to any disclaimer, the term of this patent is extended or adjusted under 35 U.S.C. 154(b) by 0 days.

(21) Appl. No.: 09/621,410

(22) Filed: Jul. 21, 2000

Related U.S. Application Data

(63) Continuation-in-part of application No. 09/265,018, filed on Mar. 9, 1999, now Pat. No. 6,142,194.

(51) Int. Cl.[7] ..... B67C 3/34

(52) U.S. Cl. ..... 141/346; 141/348; 141/351; 141/384; 141/386; 137/614; 137/614.19; 251/263

(58) Field of Search ..... 141/346, 348–354, 141/383–387; 137/614, 614.02, 614.03, 614.19; 251/95, 111, 113, 263

(56) References Cited

U.S. PATENT DOCUMENTS

| | | | | |
|---|---|---|---|---|
| 2,665,925 A | | 1/1954 | Fraser | |
| 2,729,471 A | | 1/1956 | Fraser | |
| 3,034,544 A | | 5/1962 | Griswold | |
| 3,055,405 A | | 9/1962 | Pase | |
| 3,123,099 A | | 3/1964 | Breuning et al. | |
| 3,217,747 A | | 11/1965 | Joanis et al. | |
| 3,301,272 A | | 1/1967 | Pettyjohn et al. | |
| 3,662,793 A | * | 5/1972 | Calisher et al. | 141/349 |
| 4,103,712 A | | 8/1978 | Fletcher et al. | |
| 4,192,347 A | | 3/1980 | Richard | |
| 4,359,066 A | | 11/1982 | Hunt | |
| 4,469,122 A | | 9/1984 | Meek | |
| 4,567,924 A | | 2/1986 | Brown | 141/383 |
| 5,127,428 A | | 7/1992 | Fahl | |

FOREIGN PATENT DOCUMENTS

| | | |
|---|---|---|
| EP | 0117702 A2 | 9/1984 |
| GB | 1 029 841 | 5/1966 |
| GB | 1046060 | 10/1966 |
| GB | 1416313 | 12/1975 |

(List continued on next page.)

*Primary Examiner*—J. Casimer Jacyna
(74) *Attorney, Agent, or Firm*—Oppenheimer Wolff & Donnelly LLP

(57) ABSTRACT

The invention relates to a pressure fuel servicing nozzle for mating with a standardized aircraft fueling adapter having an adapter valve biased in a closed position to prevent fuel flow. The fuel nozzle includes a nozzle body and a collar assembly coupled to the nozzle body. Fuel flow is prevented when the nozzle valve is in a fully retracted position and fuel flow is allowed when the nozzle valve is extended and when the nozzle valve pushes the adapter valve in a downstream direction. A bias member maintains the nozzle valve in fully open position when intimate contact between the valves is disrupted, such as when fuel flow forces the adapter valve further in the downstream direction. The fuel nozzle further includes a collar assembly rotatably coupled to the nozzle body such that the fuel nozzle is secured to the fueling adapter by engaging the fuel nozzle onto the fueling adapter and rotating the collar assembly about the nozzle body and fueling adapter. The collar assembly is adapted to form a first mechanical interference to prevent initial rotation of the collar: assembly about the nozzle body and fueling adapter, wherein the first mechanical interference is cleared by positioning the fuel nozzle onto the fueling adapter such that the lock tabs drive a member a distance a away from a first stop. The collar assembly is further adapted to form a second mechanical interference to prevent final rotation of the collar assembly about the nozzle body and fueling adapter, wherein the second mechanical interference is cleared by further positioning the fuel nozzle onto the fueling adapter such that the lock tabs drive the member a distance b away from a second stop. The distance b is greater than the distance a.

38 Claims, 18 Drawing Sheets

U.S. PATENT DOCUMENTS 5,293,913 A 3/1994 Preszler
5,295,507 A 3/1994 Bandy et al.
5,404,909 A 4/1995 Hanson
5,407,175 A 4/1995 Roberts et al.
5,435,413 A 7/1995 Schoenborn
5,520,418 A 5/1996 Burke
5,540,413 A 7/1996 Brown
5,765,610 A 6/1998 Brown
5,788,290 A 8/1998 Meisinger
5,947,171 A 9/1999 Woodruff
6,056,010 A * 5/2000 Wells ..... 137/614

* cited by examiner 20
136
48
82
30
46
38
42
64
62
70
24
22
132
80
26
98
40
162
36
72
160
92
28
94
96
130
76
78
44
140
140
136
108
144
88
86
84
32
34
138
144

PRESSURE FUEL SERVICING NOZZLE

RELATED APPLICATION

The present application is a continuation-in-part of copending application 09/265,018, filed Mar. 9, 1999, now U.S. Pat. No. 6,142,194. The entire content of this copending application is hereby incorporated by reference.

FIELD OF THE INVENTION

The invention relates generally to pressure fuel servicing nozzles for mating with a standardized aircraft fueling adapter having a cylindrical extension with a plurality of indexing notches and a plurality of radially extending lock tabs.

BACKGROUND OF THE INVENTION

An aircraft fuel system includes a fuel line which terminates in an exposed fueling adapter at the fuel input point. Refueling facilities include a stationary or mobile fuel supply having an extended large diameter hose or articulated pipe and various pumps for delivery of the fuel under pressure. A pressure fuel servicing nozzle is secured to the delivery end of the fuel hose or pipe and is mechanically configured to engage and receive the fueling adapter. The fuel servicing nozzle is required to perform several basic mechanical functions which include mechanically engaging and locking with the fueling adapter, providing a high pressure fuel seal between the fuel delivery hose and the aircraft fuel system, and properly valving the fuel flow between the fuel system and the aircraft to provide open flow and closed seal conditions to facilitate fueling and the termination of fueling. In addition to these basic functions, modern fuel servicing nozzles provide various safety mechanisms directed toward the prevention of fuel spillage and leakage. This is critical to the operation of such refueling systems due to the highly volatile and flammable character of aircraft fuels. One such safety mechanism provides an interlock within the fuel service nozzle which prevents opening a flow control poppet valve until the nozzle has completed proper mechanical and sealing engagement with the fueling adapter.

Referring to FIG. 1, a standardized fueling adapter 2 for commercial and military aircraft is shown. The fueling adapter 2 includes a cylindrical extension 4 with three rectangular shaped indexing slots 6 having flat engaging surfaces 7. Three lock tabs 8 extend radially outwardly from the cylindrical extension 4 and an adapter poppet valve 10 is biased in a closed position to prevent fuel flow. Due to the physically demanding operating environment of refueling an aircraft, which involves handling relatively long and heavy fueling hoses under a variety of situational urgencies as well as all weather conditions, the engagement surfaces of the lock tabs 8 are usually ramped and radiused to enable an operator to readily engage and rotate the fuel nozzle onto the fueling adapter 2, wherein scuffing or binding of the engagement mechanism of the fuel nozzle against the lock tabs 8 is reduced. Another benefit of providing ramped and radiused lock tabs 8 is the reduction in wear of the engagement mechanism.

Generally, existing fuel servicing nozzles comprise a rotating collar rotatably mounted upon a nozzle body which receives and locks with the fueling adapter to provide engagement. An interlock system prevents the opening of the flow control poppet valve within the nozzle body until mechanical engagement as evidenced by the rotational position of the collar is obtained. A receiving portion of the fuel nozzle receives and engages the fueling adapter 2, and the interlock system includes an interlock plate which prevents rotation of the collar in the absence of the insertion of the fueling adapter 2. The interlock plate is generally a flat ring shaped member which is biased onto a bayonet ring embedded within the collar. When the fuel nozzle is not connected to the fueling adapter 2, the engagement surfaces of the interlock plate abut against the blocking walls extending outwardly from the inner surface of the bayonet ring.

To connect the fuel nozzle to the fueling adapter 2 an operator aligns three locating pins of the fuel nozzle with the indexing slots 6 of the fueling adapter 2. When the fuel nozzle is aligned, the fuel nozzle can be pushed into the fueling adapter 2, thereby depressing the interlock plate away from the inner surface of the bayonet ring to clear the blocking wall and allowing the collar to be rotated about the nozzle body. After full rotation of the collar, an operating handle is now free to be rotated to open the flow control poppet valve. Of particular note is that the ramped and radiused lock tabs 8 may allow rotation of the collar prior to full depression of the interlock plate. This partial depression of the interlock plate by an incomplete engagement allows the start of the rotation of the collar. Furthermore, the interlock system is designed to disengage under a less than full depression of the interlock plate because of timing issues dealing with the physical relationship of the axial movement of the interlock plate with respect to the rotational movement of the collar as defined by the ramped and radiused lock tabs. Thus, the height of the blocking surface is. usually substantially less than the clearance provided by a full depression of the interlock plate.

The features discussed above to allow easy coupling of the fuel nozzle to the fueling adapter 2 effects the safety of the connection because the nozzle body may not be held in the correct position when the collar is being rotated about the fueling adapter during both connection and disconnection. A situation may arise where the fuel nozzle is connected to the fueling adapter 2 where the longitudinal axis of the fuel nozzle is slightly skewed with the longitudinal axis of the fueling adapter 2. As a result, a gap may exist in the fuel seal between the contacting surfaces of the fuel nozzle and fueling adapter 2. If the improper connection sufficiently depresses the interlock plate to clear the blocking walls of the bayonet ring, the interlock system may be defeated and an operator may be able to rotate the operating handle and open the fuel nozzle, and a dangerous fuel spill may result.

In another possible situation, the fuel nozzle may be properly aligned and coupled to the fueling adapter 2, but the lock tabs 8 of the fueling adapter 2 may be worn to the extent that the fuel nozzle may be removed from the fueling adapter 2 under an unsafe condition such as when the collar assembly is not fully rotated in the closed direction with respect to the body when disconnection from the fueling adapter 2 occurs, due to worn lock tabs 8 which exhibit thinning in critical regions. In this case, the interlock plate does not return to the locking condition and the abutting surfaces of the bayonet ring and the interlock plate are not mated. With the interlock feature so defeated, the collar can be rotated back to the open position when not attached to the fueling adapter 2, thereby allowing the operating handle to then be rotated to open the nozzle.

Another problem which may arise in existing fuel servicing nozzles is the unintentional disengagement of the flow control poppet valve from the fully open position to an intermediate open position during the refueling process. When the fuel nozzle is connected to the fueling adapter 2, rotation of the operating handle causes the flow control poppet valve to be pushed into the fueling adapter 2 and consequently pushes open the corresponding spring loaded, adapter poppet valve 10. The spring from the adapter poppet valve maintains both poppet valves in intimate contact and applies a force in the upstream direction that keeps the internal components of the fuel nozzle in the fully open position, due to an over-center locking condition of a crankshaft. During relatively high flow rates, the adapter poppet valve 10 may be pushed further in the downstream direction by the flowing fuel impinging on the adapter poppet valve 10. Intimate contact between the poppet valves is disrupted, and the flow control poppet valve no longer receives a force in the upstream direction from the adapter poppet valve. Consequently, the flow control poppet valve and related internal components are free to rotate and/or travel to a position other than the fully open position.

Typically, it is highly desireable to refuel an aircraft as quickly as possible. This is particularly important in the commercial airline industry where market conditions are extremely competitive and in the military where combant readiness of an aircraft is highly desireable. If the operating handle is unknowingly disengaged from the fully open position during refueling, which may occur during an abrupt increase in fuel flow, fuel flow may be reduced and the period for the refueling may be increased unless the operator rotates the operating handle back to the fully open position.

Thus, there remains a need. for an improved aircraft fuel servicing nozzle designed to connect and disconnect to a standardized fueling adapter mounted on an airframe and connected to an internal fuel manifold and tank system. In particular, a reliable, rugged, and safe fuel servicing nozzle is desireable which is light weight and easy to operate.

BRIEF SUMMARY OF THE INVENTION

In accordance with the present invention, an exemplary embodiment of an improved aircraft fuel servicing nozzle is provided which is designed to connect and disconnect with a standardized fueling adapter mounted on an airframe and connected to an internal fuel manifold and tank system. The present invention achieves the objective of connecting and disconnecting with a fueling adapter, such as the version shown in FIG. 1, in a reliable, rugged, and safe manner and yet being relatively light weight and easy to operate.

The fuel servicing nozzle comprises a nozzle body having an outer surface an interior passage. A collar assembly is rotatably supported upon the outer surface of the nozzle body. A valve operating handle is rotatively coupled to the nozzle body. A plurality of locating pins extend outwardly from a distal base of the nozzle body. It is noted that "distal" refers to a downstream end and "proximal" refers to an upstream end of the fuel servicing nozzle. The fuel nozzle is aligned onto the fueling adapter by fitting the locating pins into the indexing notches of the fueling adapter. The fuel servicing nozzle further includes an interlock plate biased towards an inner surface of a bayonet ring, and the interlock plate includes engagement surfaces. Primary interlock stops extend outwardly from the inner surface of the bayonet ring a distance a, and adjacent to each primary interlock stop is a secondary interlock stop extending outwardly from the inner surface of the bayonet ring a distance b, where b is greater than a.

When the fuel servicing nozzle is not connected to the fueling adapter, rotation of the collar assembly relative to the nozzle body is prevented by the engageable surfaces of the interlock plate abutting against the primary interlock stops. When the fuel nozzle is inserted into the fueling adapter, the interlock plate is depressed toward the nozzle body and the mechanical interference between the primary interlock stops and engageable surfaces is cleared such that the collar assembly is free to partially rotate about the nozzle body and fueling adapter. As in existing fuel nozzles, partial depression of the interlock plate is adequate to clear the primary interlock stops. Thus, an operator is able to perform the steps of inserting, aligning, and partially rotating the collar assembly with relative ease. With the collar assembly attached to the fueling adapter, the operator has an opportunity to more carefully align the fuel nozzle and fully depress the interlock plate to clear the secondary stops and rotate the collar assembly to the fully secured position, wherein a proper seal is formed between the fuel nozzle and fueling adapter. After full rotation of the collar, the operating handle may now be rotated to open the nozzle poppet valve and to allow fuel flow. If the operator is unable to properly align the fuel nozzle and clear the secondary interlock stops, further rotation of the collar assembly towards the secured direction is prevented, and the operator will not be able to rotate the operating handle to open the nozzle poppet valve. Of course, the steps of partially rotating and fully rotating the collar assembly may appear seamless, particularly with an experienced operator.

Another feature of the fuel nozzle of the present invention is that the interlock system prevents the opening of the flow control poppet valve when the fuel nozzle is coupled to an unsafe fueling adapter having worn lock tabs. The lock tabs may adequately. depress the interlock plate to clear the primary interlock stops. However, the lock tabs may not be sufficiently thick to fully depress ,the interlock plate to clear the secondary interlock stops, thereby preventing full rotation of the collar assembly and rotation of the operating handle to open the nozzle poppet valve. Thus, the potential problem of decoupling the fuel nozzle from the fueling adapter with the flow control poppet valve in an open position and with fuel flowing may be avoided.

The fuel nozzle of the present invention may further include a bias member to maintain the flow control poppet valve in the fully open position to maximize the flow rate of fuel and minimize refueling time. In other words, once the operating handle is rotated to the fully open position, the bias member maintains the flow control poppet valve in the fully open position under various operating conditions which may otherwise cause the flow control poppet valve to undesirably move towards the close direction. If the flow control poppet valve is unknowingly disengaged from the fully open position during refueling, and an operator fails to rotate the operating handle back to the fully open position, fuel flow may be reduced and the refueling time may be increased.

In accordance with the exemplary embodiment, the fuel service nozzle includes a valve stem slidingly guided by a sleeve, and a proximal end of the valve stem is connected to a crank arm of a crankshaft by a V-shaped arm, while the distal end of the valve stem is connected to the flow control poppet valve. Rotation of an operating handle rotates the crankshaft and causes the V-shaped arm to translate a rotating motion to an axial motion of the valve stem. The V-shaped arm allows for limits of the rotation of the crankshaft, wherein the limits are "past top dead center" and "past bottom dead center". As the operating handle is rotated to the fully open position, the crankshaft passes "bottom dead center" to the "past bottom dead center" position and remains in the "past bottom dead center" position due to the adapter poppet valve directing an upstream directed force upon the flow control poppet valve. When intimate contact between the poppet valves is disrupted, a bias member provides the force required to maintain the flow control poppet valve in the fully open position. In an exemplary embodiment, the bias member includes a spring disposed at a proximal end of the sleeve and is compressed between the proximal end of the sleeve and a proximal region of the valve stem when the flow control poppet valve is in the fully open position. As the spring is compressed, a force in the upstream direction is directed to the valve stem, wherein an upstream force upon the valve stem is provided by compression of the spring.

Other objects, features, and advantages of the present invention will become apparent from a consideration of the following detailed description.

DETAILED DESCRIPTION OF THE PREFERRED EMBODIMENTS

Figure 1:
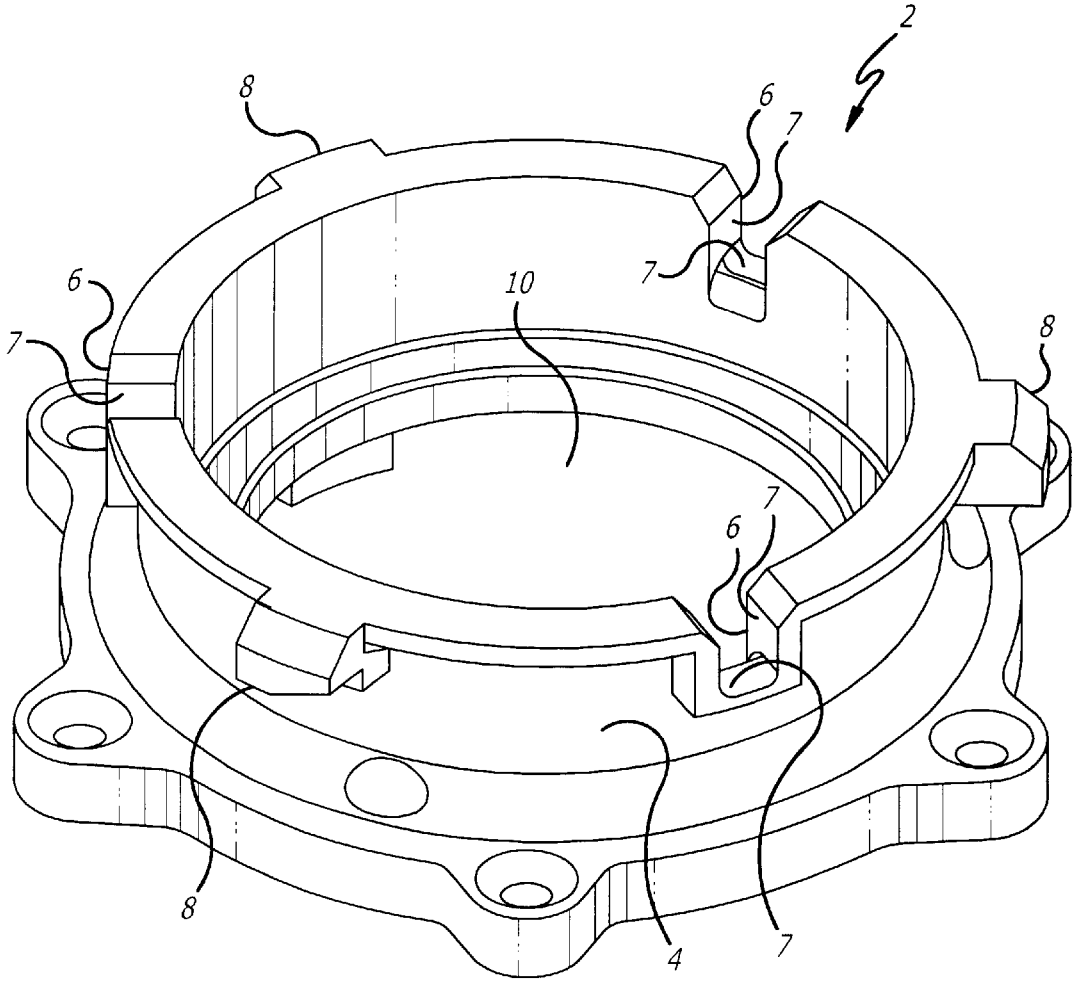
FIG. 1 (PRIOR ART)
FIG. 1 is a perspective view of a standardized fueling adapter which mates with a fuel servicing nozzle of the present invention.

In the particular embodiments shown in the drawings and herein described, fuel servicing nozzles for mating with a standardized aircraft fueling adapter. However, it should be understood that the principles of the present invention are equally applicable to any form of fuel servicing nozzle. Therefore, it is not intended to limit the principles of the present invention to the specific embodiment shown and such principles should be broadly construed.

Figure 9:
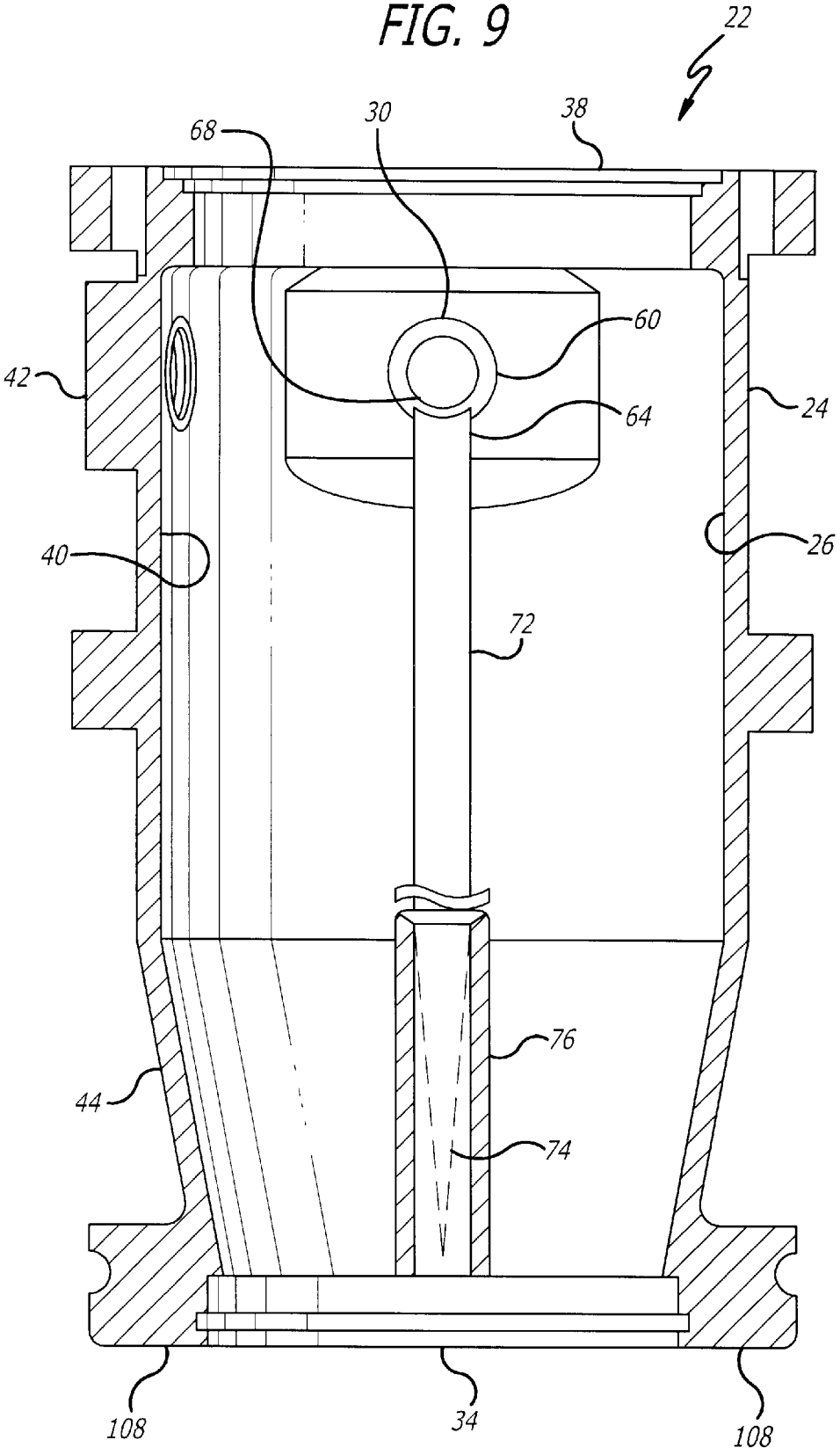
FIG. 9 is a cross-sectional view taken through the nozzle body along line 9—9 of FIG. 8.

Referring to FIGS. 2–11, 15–17, and 18A–18B, an aircraft pressure fuel servicing nozzle 20 of the present invention is illustrated. The fuel nozzle 20 includes a nozzle body 22 having an outer surface 24 and an interior passage 26 extending therethrough as illustrated in FIG. 9. A collar assembly 28 is rotatably supported upon the outer surface 24 of the nozzle body 22, and a crankshaft 30 extends across the entire inner diameter of the interior passage 26. A flow control poppet valve 32 seals a distal end 34 of the nozzle body 22, and a valve stem 36 connects the crankshaft 30 to the flow control poppet valve 32.

A proximal end 38 of the nozzle body 22 is connected to a fuel delivery coupling such as a fuel delivery hose (not shown) or the like and the distal end 34 mates with a standardized aircraft fueling adapter 2 as illustrated in FIG. 1. To provide high fuel flow rates, an interior side wall 40 of the nozzle body 22 is smoothly contoured and includes a proximal portion 42 which is generally cylindrical-shaped and a distal portion 44 which is generally cone shaped. In addition, the interior wall 40 is smoothly finished to promote fuel flow. In the embodiment illustrated in the figures, the nozzle body 22 is integrally formed from an investment casting and is made from a lightweight and strong metal such as aluminum.

Referring back to FIG. 4, the crankshaft 30 extends transversely across the nozzle body 22 and is above the valve stem 36. The crankshaft 30 comprises a main shaft 46 and a crank arm 48 which is disposed near the midlength of the main shaft 46 and extends radially outwardly from the main shaft 46. A first end 50 of the main shaft 46 is supported by a bearing 52 formed in a recess 54 in the side wall of the nozzle body 22. A second end 56 of the main shaft 56 extends through a bearing sleeve 58 disposed in an opening 60 in the opposite side wall of the nozzle body 22. The second end 56 of the main shaft 46 is connected to a valve operating handle 62 which provides a means of rotating the crankshaft 30.

In addition to being supported at both ends 50, 56 by the bearings 52, 58, the crankshaft 30 is further supported by a cradle 64 as illustrated in FIG. 9. The cradle 64 extends from one side wall 40 to the opposite side wall 40 of the nozzle body 22 and may have a thickness equal to or less than the diameter of the crankshaft 30. The top surface 66 of the cradle 64 is concave-shaped to conform to the diameter of the crankshaft 30. Preferably, a gap 68 about three to five thousands of an inch exists between the top surface 66 and the outer surface of the crankshaft 30. When the crankshaft 30 is under a load such as when the fuel is pressurized and the flow control poppet valve 32 is closed, the crankshaft 30 may come into contact with the top surface 66, thus being fully supported by the cradle 64 and resistant to bending.

Referring back to FIGS. 3 and 4, a rectangular slot 70 is located near the center portion of the cradle 64 to allow clearance for the rotation of the crank arm 48. The cradle 64 is formed on top of a web 72 which is generally a flat wall extending radially outwardly with sides contacting the side wall 40 of the nozzle body 22. The web 72 is about 0.4 inch thick near the cradle 64 and tapers to a reduced thickness near a distal end 74 to promote a smooth flow path for the fuel. A cylindrically shaped sleeve 76 is formed in the distal portion 78 of the web 72. The outer diameter of the sleeve 76 is about 0.6 inch and the inner diameter is about 0.4 inch. By providing the combined features of the full length crankshaft 30 which extends across the entire inner diameter of the interior passage 26, the cradle 64, and the web 72, the fuel nozzle 20 is highly reliable and robust. It is also noted that the cradle 64, web 72 and sleeve 76 are integrally formed with the nozzle body 22.

Referring back to FIGS. 3 and 4, the valve stem 36 is slidingly guided by the sleeve 76, and a proximal end 80 of the valve stem 36 is connected to the crank arm 48 by a V-shaped arm 82 while a distal end 84 of the valve stem 36 is directly connected to the flow control poppet valve 32. The flow control poppet valve 32 is movable along the longitudinal axis of the nozzle body 22, and is configured to engage and form a sealing contact with an interior surface 86 of a nose seal 88 formed from a polyester polyurethane. The position of the flow control poppet valve 32 with respect to the nose seal 88 determines the open and closed positions for the fuel nozzle 20. This position is determined by the rotational position of the valve operating handle 62 and crankshaft 30. The flow control poppet valve 32 is screwed onto the distal end 84 of the valve stem 36 by threads such that the position of the flow control poppet valve 32 relative to the interior surface 86 of the nose seal 88 may be finely adjusted for proper sealing.

Rotation of the operating handle 62 causes the V-shaped arm 82 to translate a rotating motion to an axial motion of the valve stem 36. The valve stem 36 slides through the sleeve 76, and the flow control poppet valve .32 to travel from the fully closed position to the fully open position. When connected to the fueling adapter 2, the adapter poppet valve 10, which is biased in the closed position by a spring 12, is pushed into an open position as the flow control poppet valve 32 travels from the fully closed position to the fully open position. Thus, a flow conduit into the fuel system of the aircraft is established. The V-shaped arm 82 allows the crankshaft 30, to have rotational limits of "past top dead center" and "past bottom dead center" such that the total rotation of the crankshaft 30 is about 210 degrees. With the crankshaft 30 at "past top dead center", the flow control poppet valve 32 is fully closed. To move the flow control poppet valve 32 towards the open position, the crankshaft 30 is rotated away from "past top dead center" so that it passes "top dead center" while rotating towards "bottom dead center". Similarly, with the crankshaft 30 at "past bottom dead center", the flow control poppet valve 32 is at the fully open position. To move the flow control poppet valve 32 towards the fully closed position, the crankshaft 30 is rotated away from "past bottom dead center" such that it passes "bottom dead center" while rotating towards "top dead center". Due to the over-center condition of the crankshaft 30, the flow control poppet valve 32 may be biased to remain in the fully open position by directing an upstream directed force on the valve stem 36. Similarly, the flow control poppet valve 32 may be biased to remain in the fully closed position by directing a force on the valve stem in the downstream direction.

In the exemplary embodiment illustrated in the figures, flow control poppet valve 32 is biased to remain in the fully closed position where the crankshaft 30 is positioned at "past top dead center", due to the nose seal 88 directing a force in the downstream direction upon the flow control poppet valve 32 when the flow control poppet valve 32 compresses the rubber of the nose seal 88 and effects a seal. When the operating handle 62 is rotated to the fully open position, the flow control poppet valve 32 is biased to remain in the fully open position, "past bottom dead center", due to the adapter poppet valve 10 directing a force upon the flow control at poppet valve 32 in the upstream direction.

In the event that intimate contact between the poppet valves 10, 32 is disrupted, such as during a sudden increase in fuel flow, a bias member 92 provides the necessary upstream directed force on the flow control poppet valve 32 to maintain a fully open position. In the exemplary embodiment shown in FIGS. 3 and 4, the bias member 92 is a wave spring 94 disposed around the valve stem 36 and adjacent a proximal shoulder 96 of the sleeve 76 so that it is compressed between a proximal region 98 of the valve stem 36 and the shoulder 96 of the sleeve 76 as the crankshaft 30 travels from "past top dead center" to "bottom dead center". As the crankshaft 30 travels past "bottom dead center", the spring load from the wave spring 94 is partially or fully relaxed. At the partially or fully relaxed state, the wave spring 94 is available to provide a force to oppose the travel of the valve stem 36 to the "bottom dead center", thereby preventing movement of the valve stem 36 and related rotation of the crankshaft 30. The wave spring 94 does not have to be secured to the shoulder 96 of the sleeve 76. In other words, the wave spring 94 may be allowed to slide along the valve stem 36 when the flow control poppet valve 32 is in any position aside from the fully open position. Furthermore, the wave spring 94 may be secured to the upstream region of the valve stem 36 instead of the upstream shoulder 96 of the sleeve 76.

Figure 3:
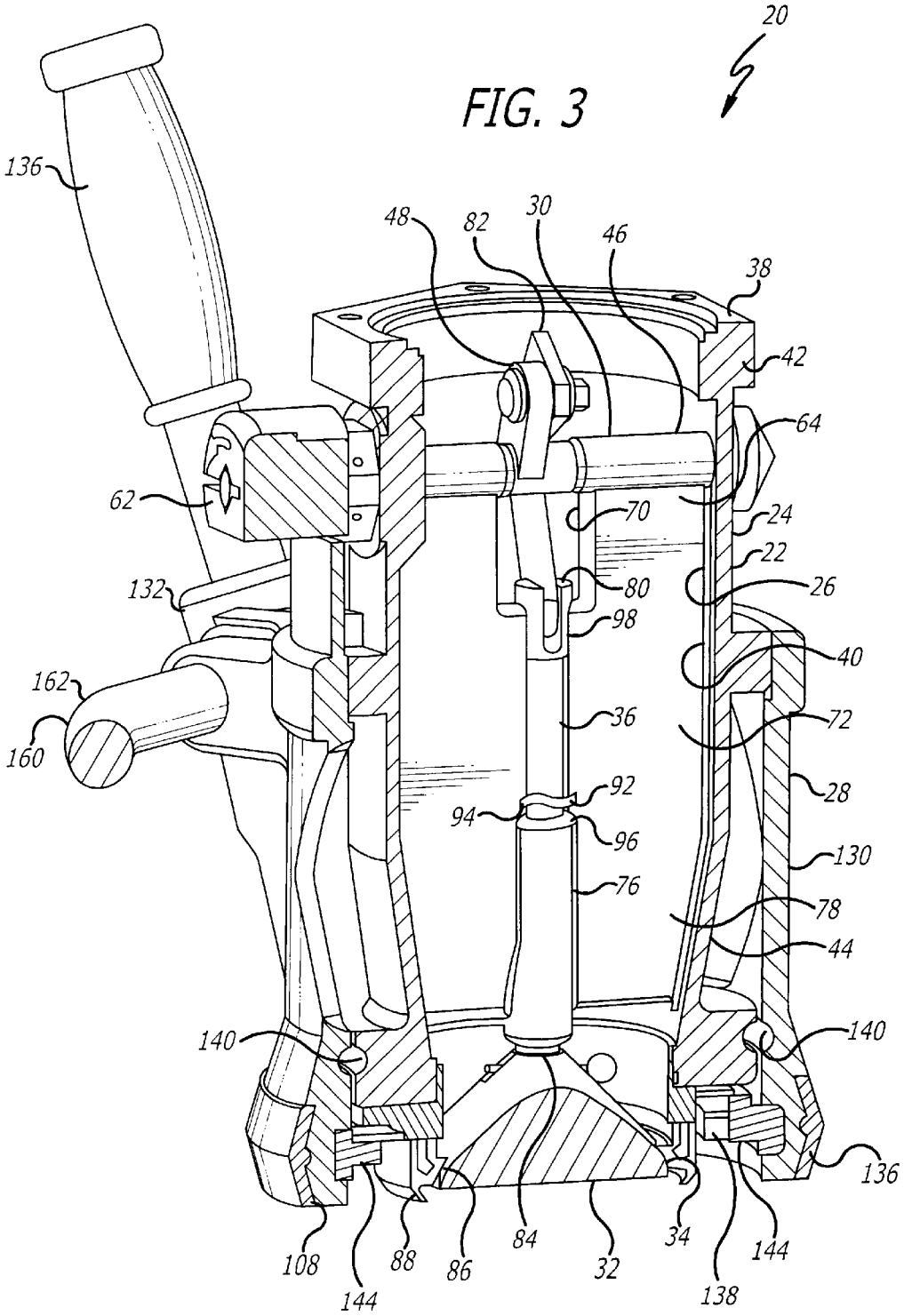
FIG. 3 is a cross-sectional and perspective view taken through the fuel servicing nozzle along plane 3—3 of FIG. 2.
Figure 4:
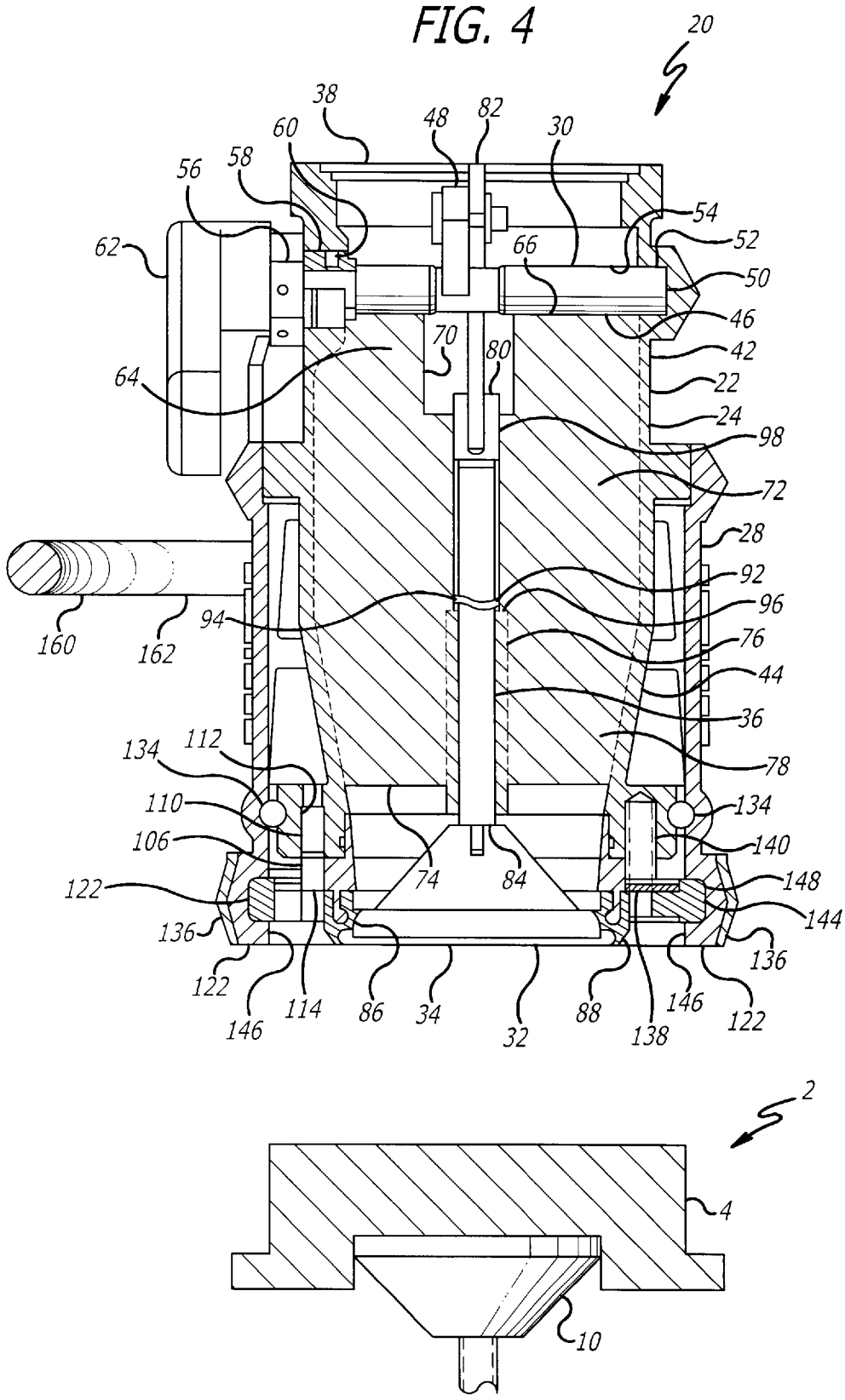
FIG. 4 is a cross-sectional view taken through the fuel servicing nozzle along plane 3—3 of FIG. 2.
Figure 5:
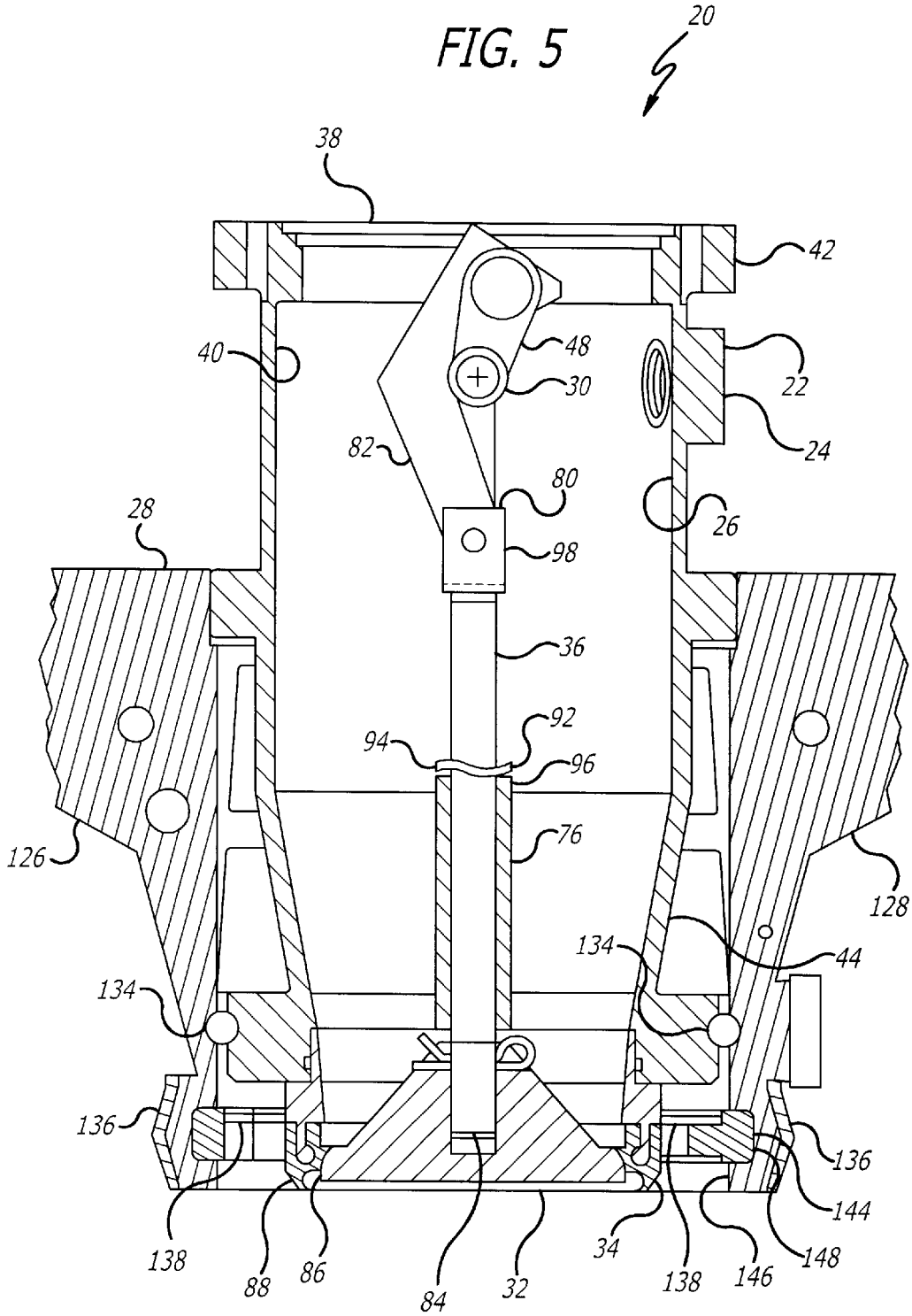
FIG. 5 is a cross-sectional view taken through the fuel servicing nozzle perpendicular to plane 3—3 of FIG. 2.
Figure 6:
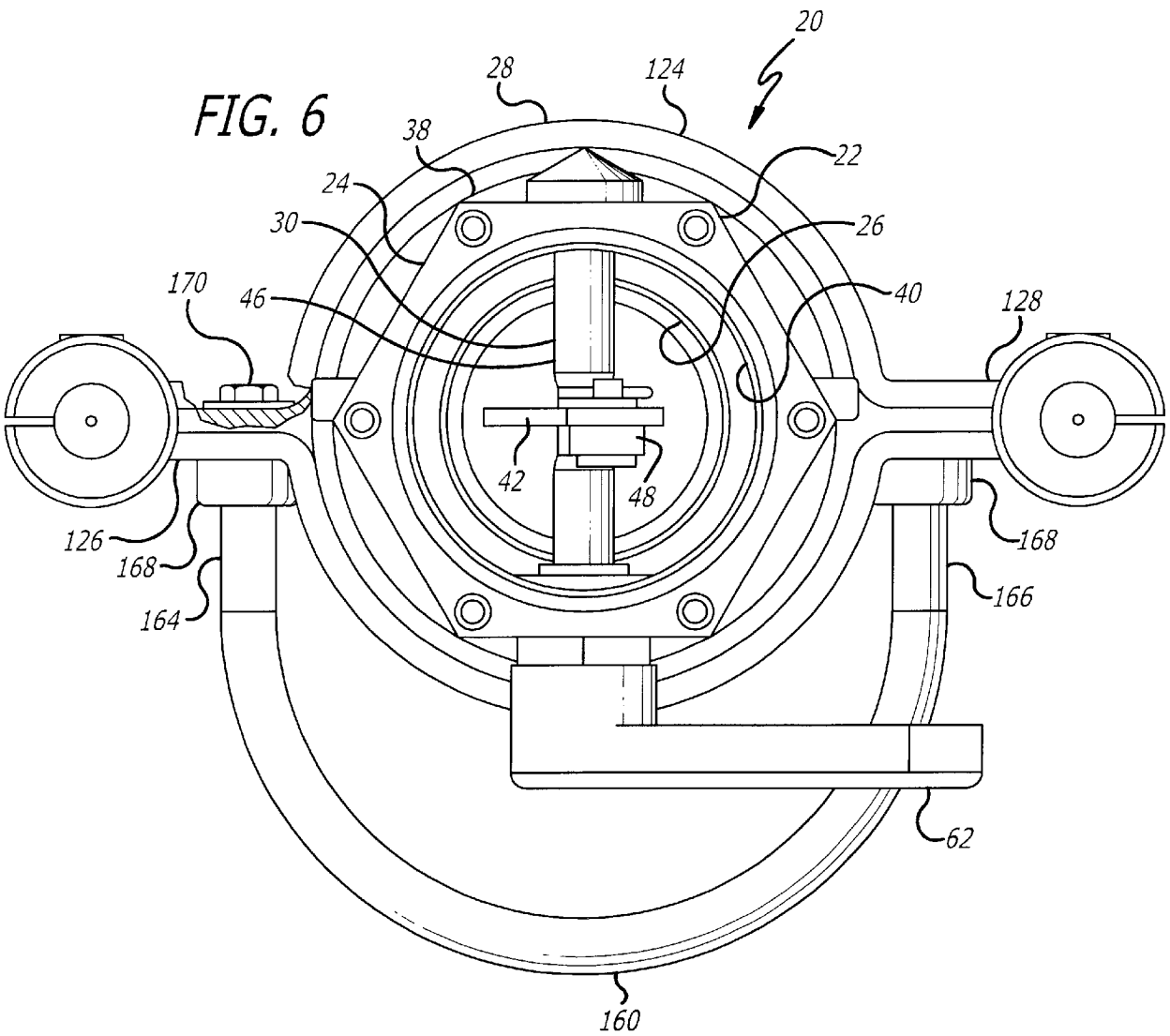
FIG. 6 is a plan top view of the fuel service nozzle shown in FIG. 2.
Figure 7:
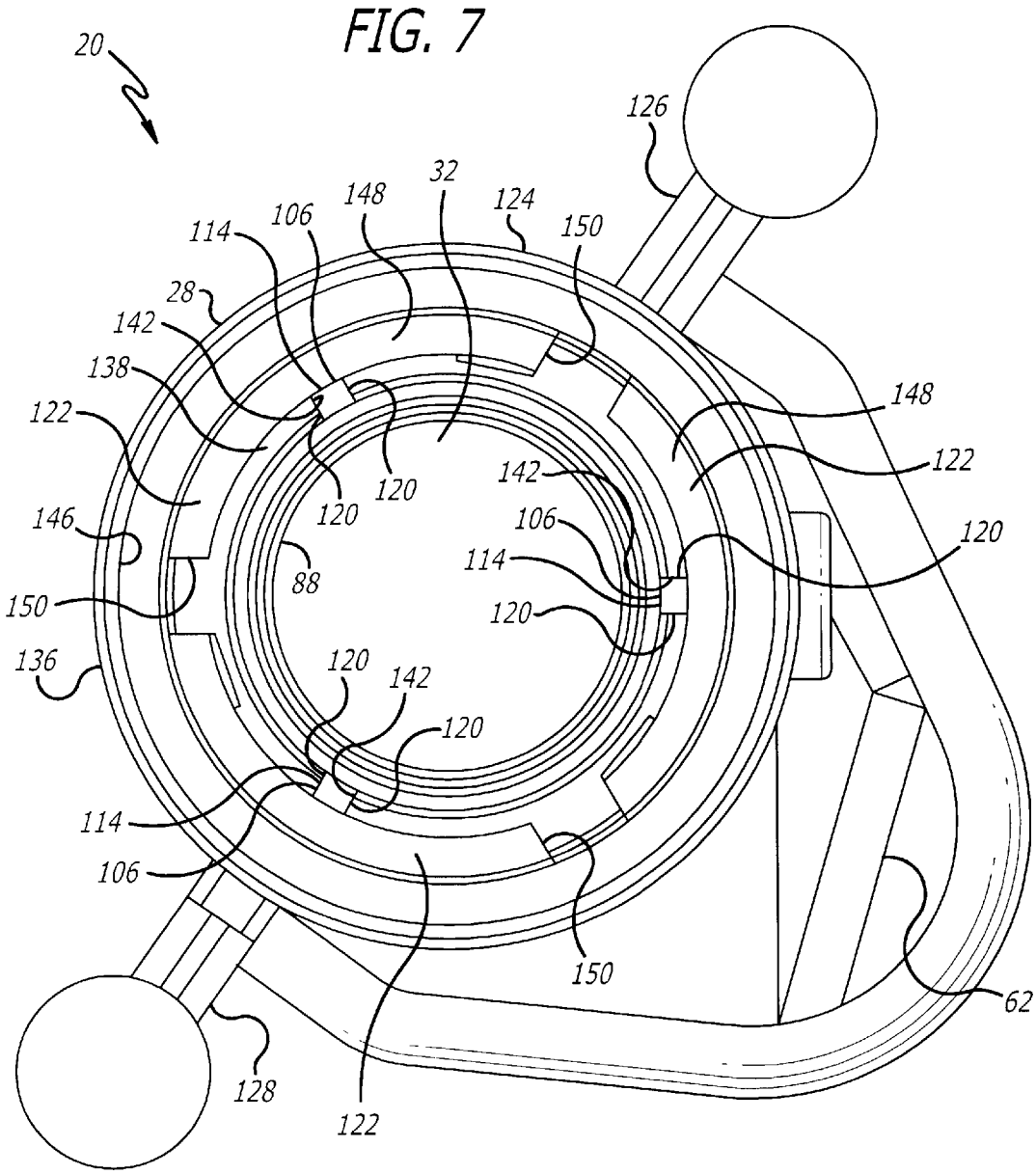
FIG. 7 is a plan bottom view of the fuel service nozzle shown in FIG. 2 illustrating square locating pins.
Figure 8:
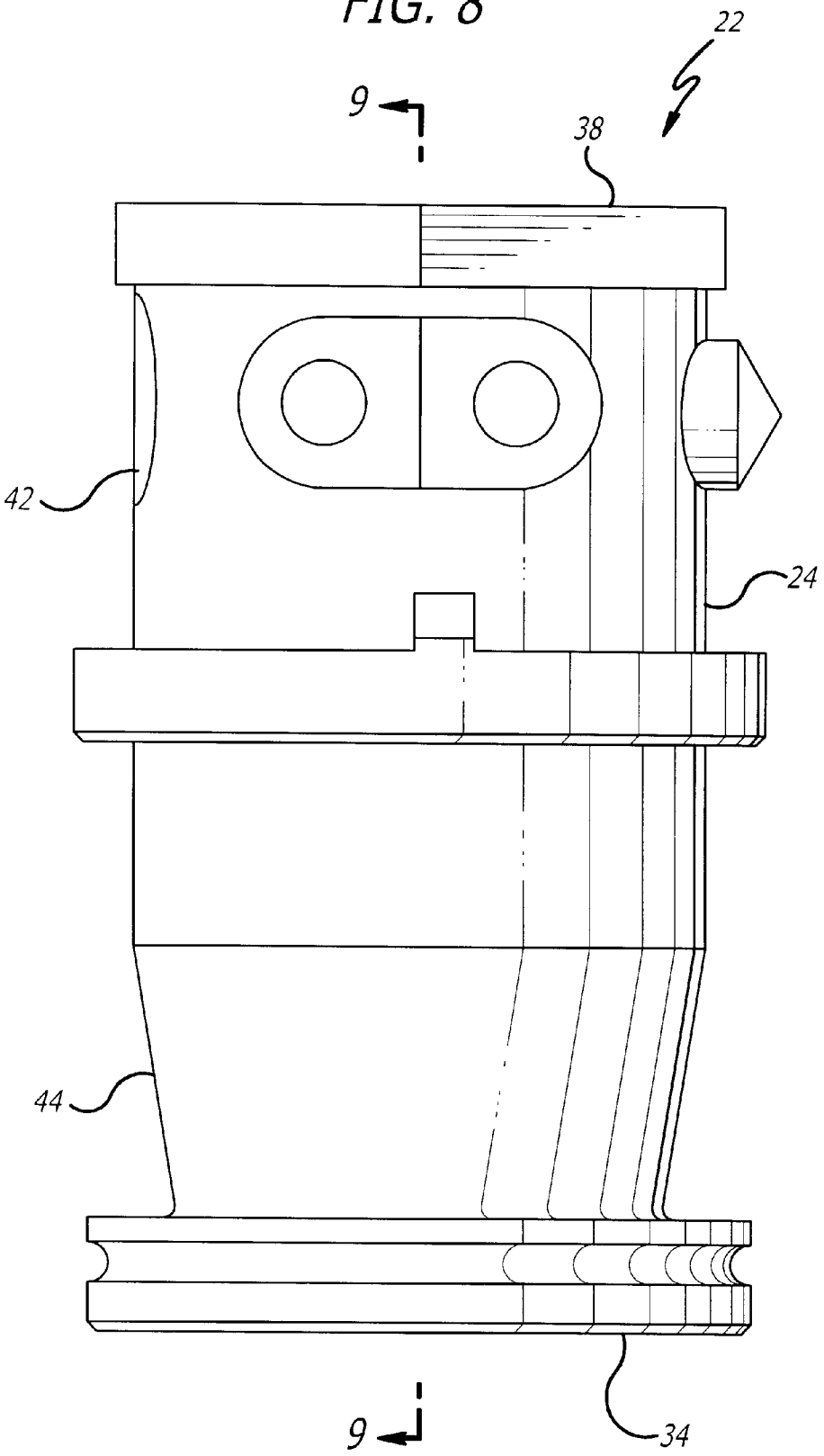
FIG. 8 is a plan side view oft he nozzle body.
Figure 12:
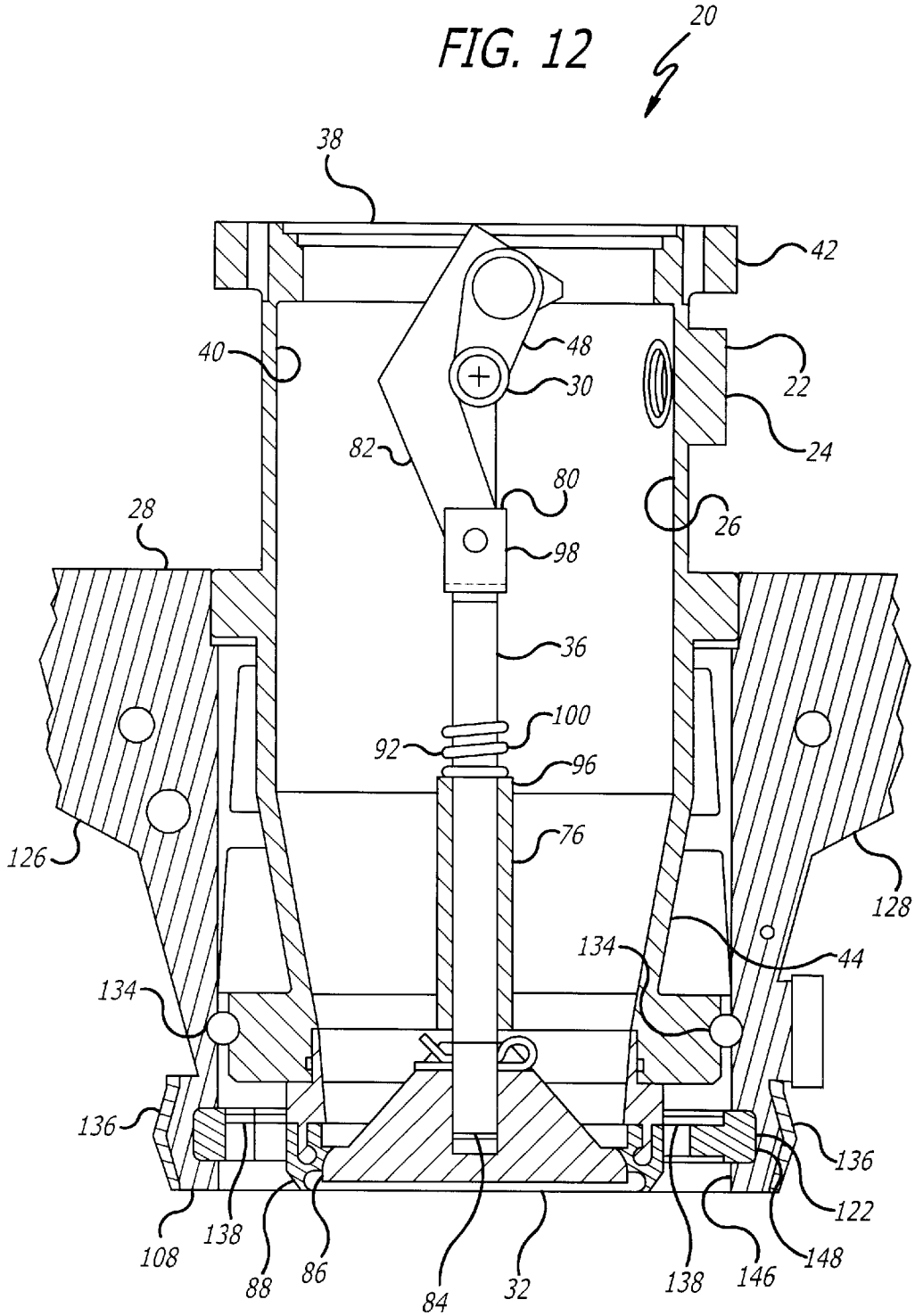
FIG. 12 is a cross-sectional view of a fuel servicing nozzle illustrating an alternative bias member in accordance with the present invention.
Figure 13:
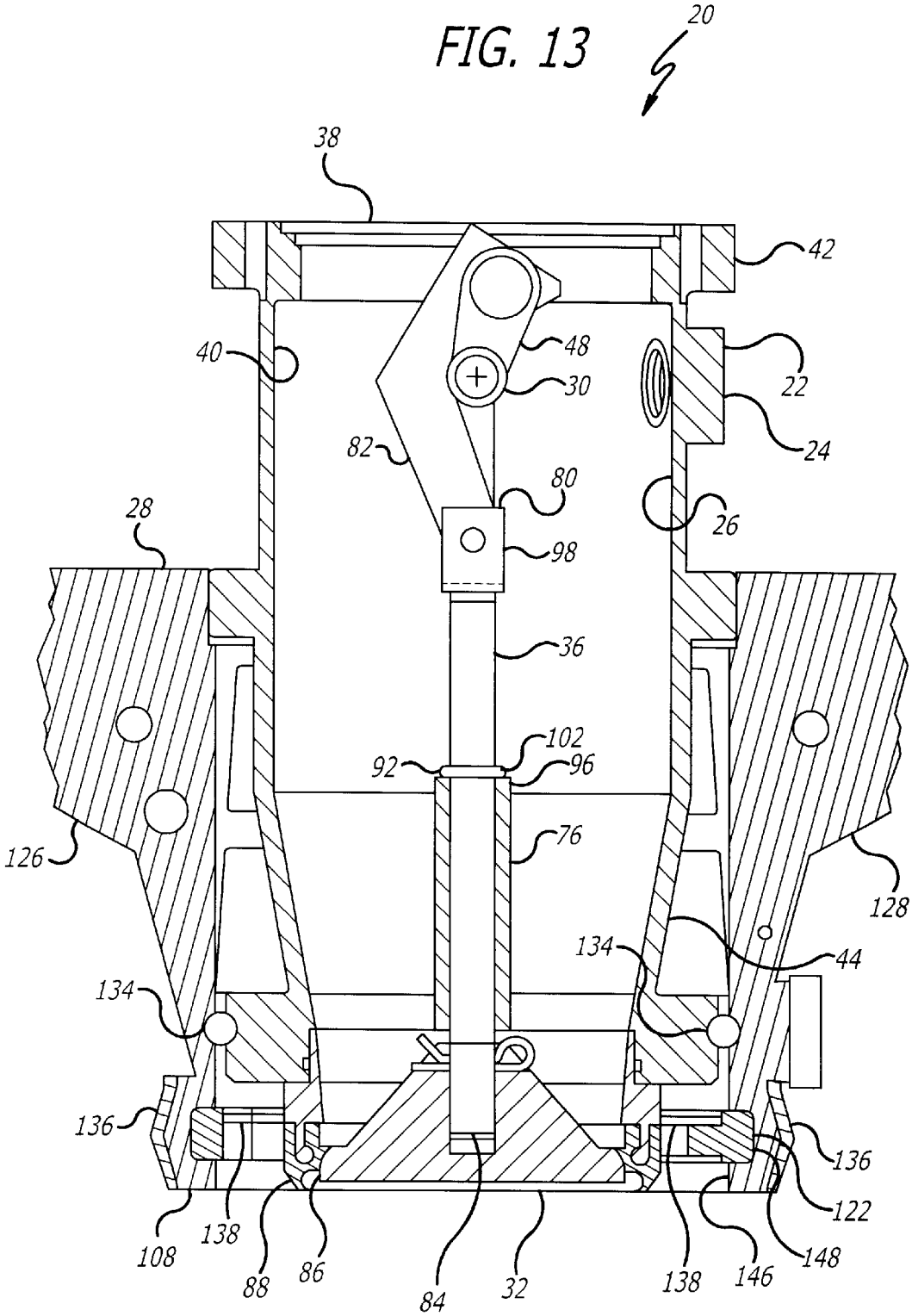
FIG. 13 is a cross-sectional view of a fuel servicing nozzle illustrating a further alternative bias member in accordance with the present invention.
Figure 14:
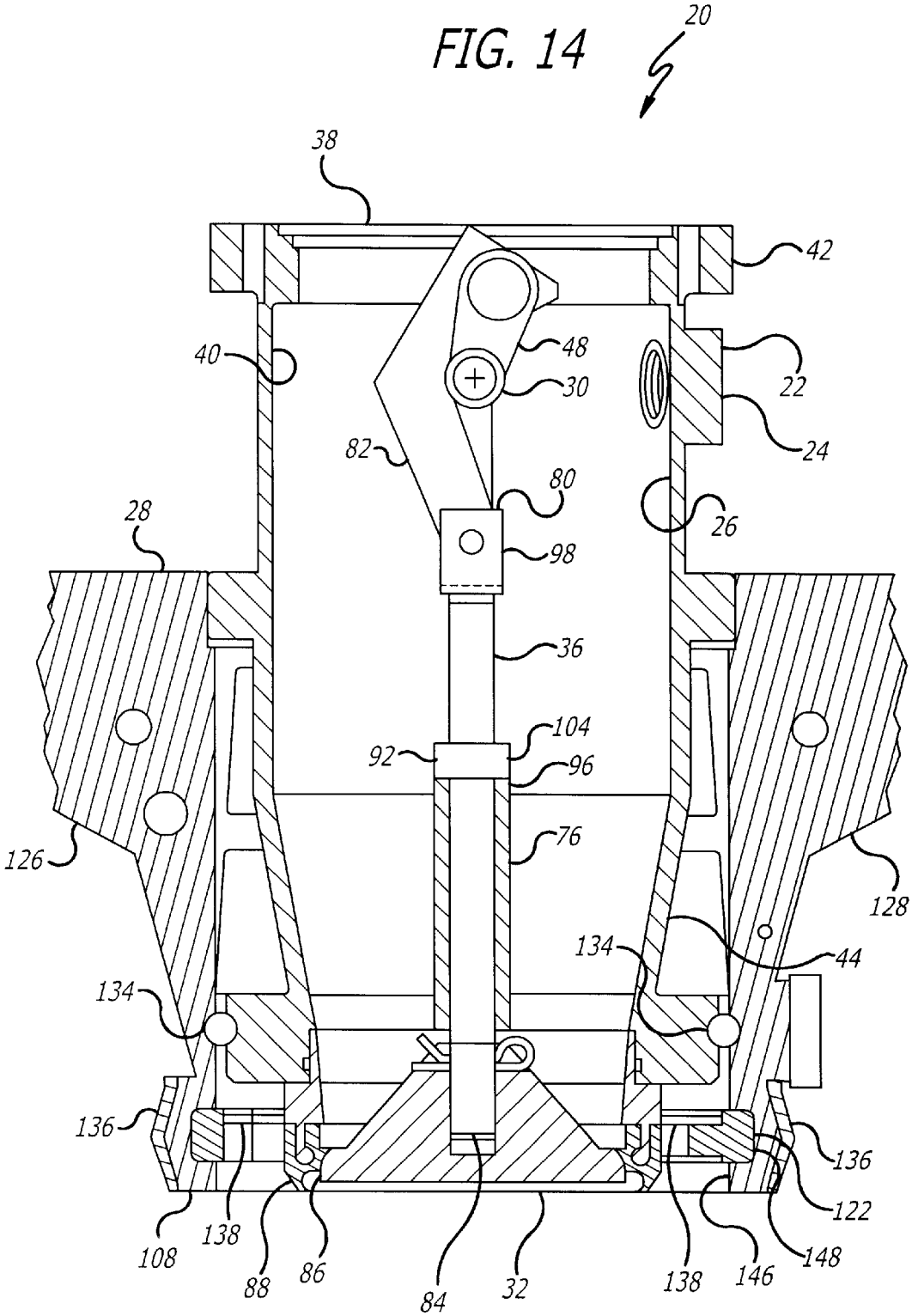
FIG. 14 is a cross-sectional view of a fuel servicing nozzle illustrating a still further alternative bias member in accordance with the present invention.
Figure 15:
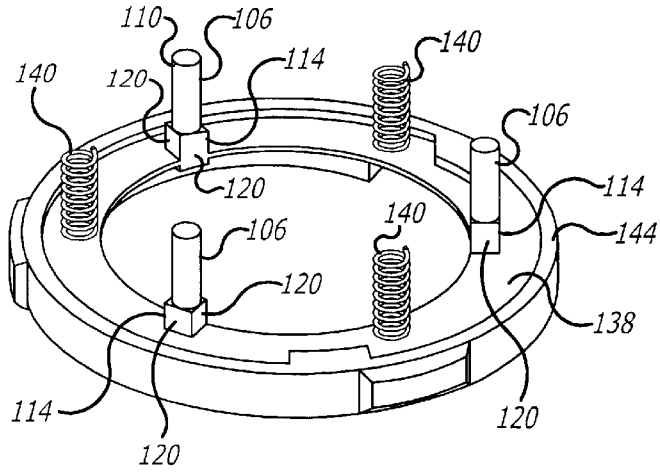
FIG. 15 is a perspective view illustrating a portion of the safety interlock of the fuel servicing nozzle of FIG. 2.
Figure 16:
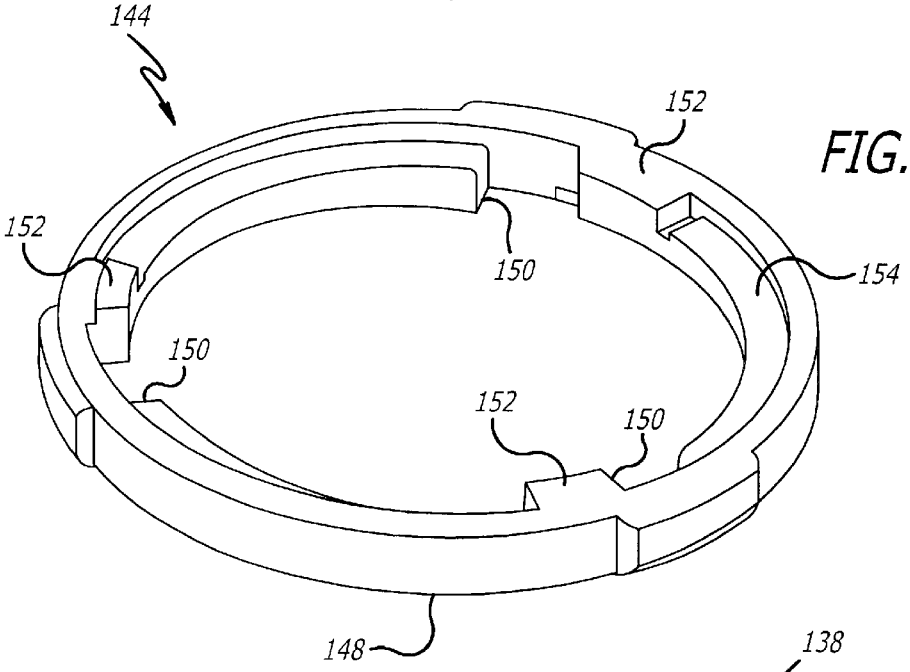
FIG. 16 is a perspective view illustrating a bayonet ring of the fuel servicing nozzle of FIG. 2.
Figure 17:
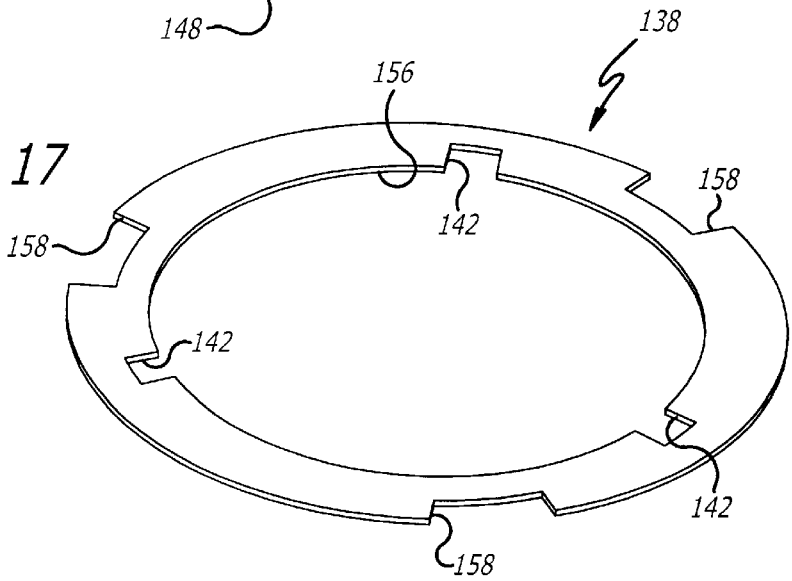
FIG. 17 is a perspective view illustrating an interlock plate of the fuel servicing nozzle of FIG. 2.
Figure 18A:
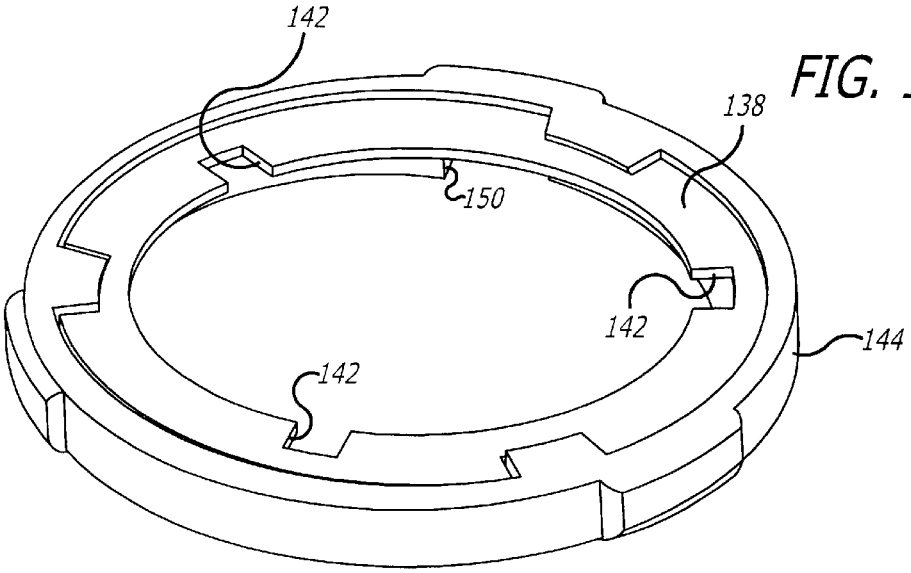
FIGS. 18A and 18B are perspective views illustrating the interlock plate in an unsecured and secured position, respectively.
Figure 18B:
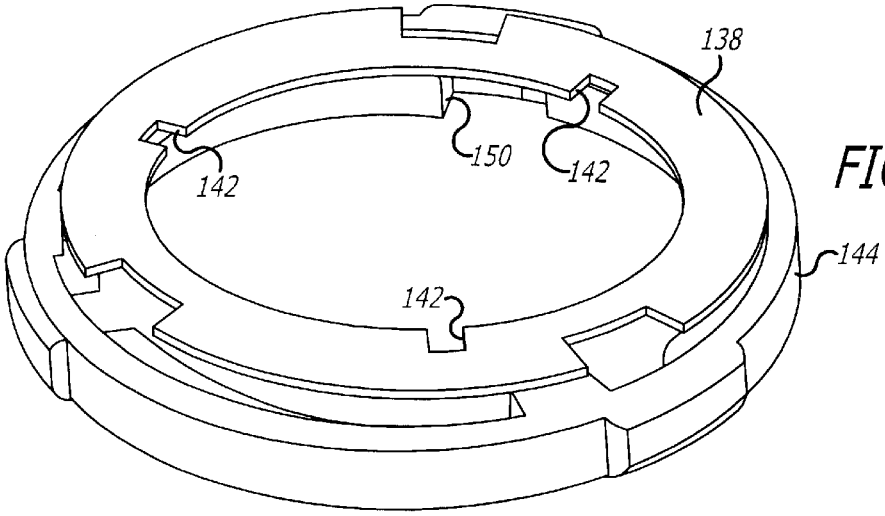
Figure 19:
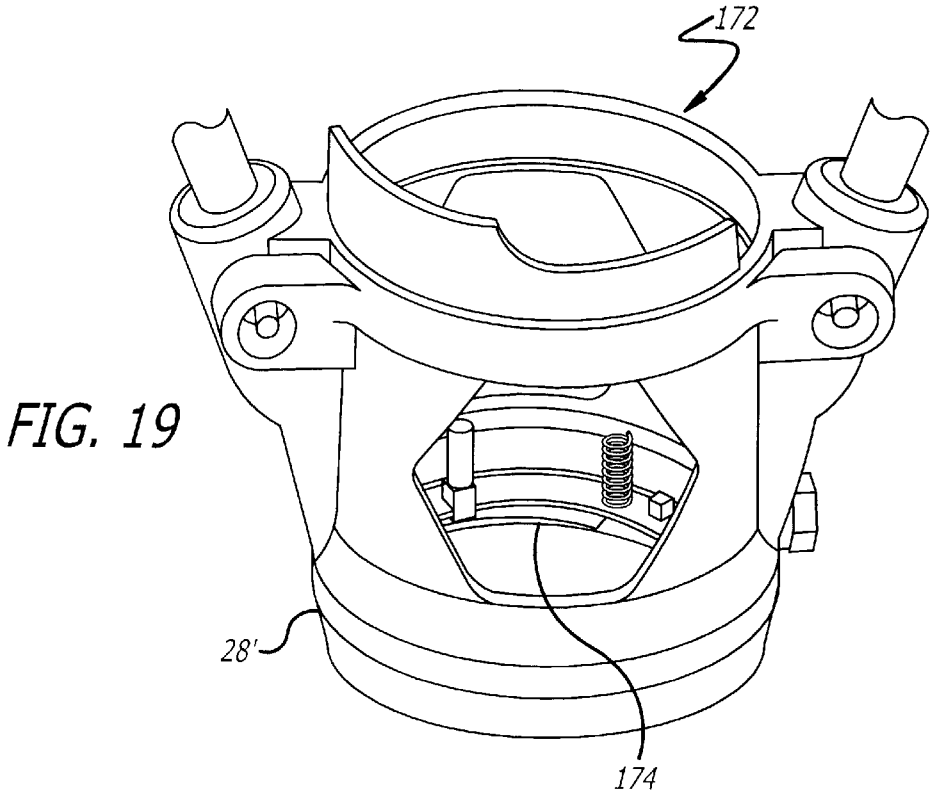
FIG. 19 is a downward perspective view illustrating a portion of another embodiment of a fuel servicing nozzle having a back-up safety interlock in accordance with the present invention.
Figure 20:
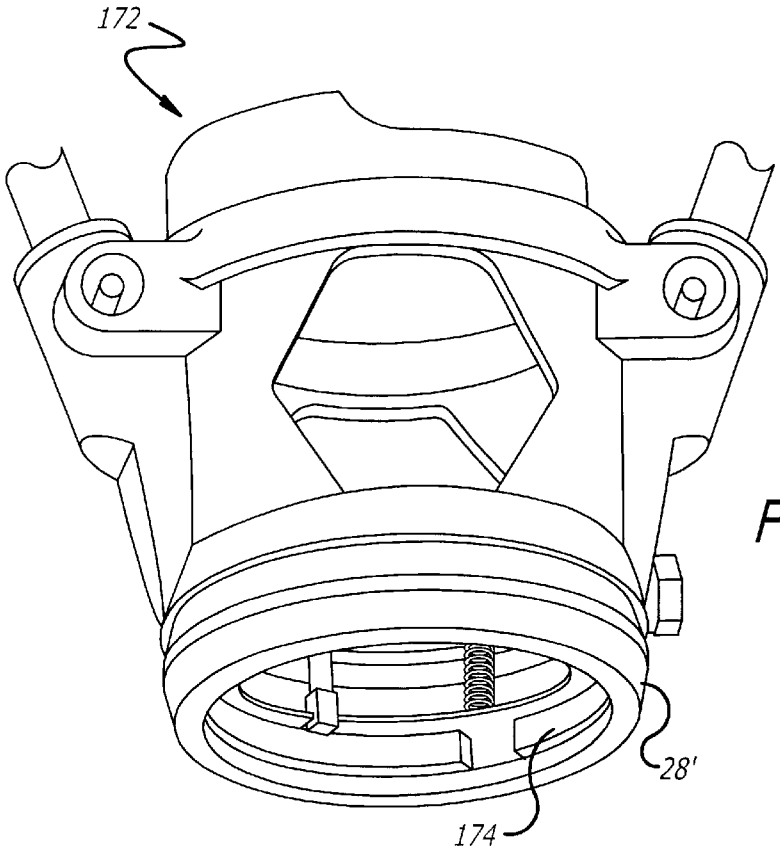
FIG. 20 is a upward perspective view illustrating a portion of the fuel servicing nozzle of FIG. 19.

The bias member 92 is not limited to the wave spring 94 shown in FIGS. 3 and 4. The bias member 92 may be carried out with any other type of mechanism which provides an upstream directed force when compressed. For example, FIGS. 12–14 respectively illustrate a fuel servicing nozzle 20 with a coil spring 100, O-ring 102, and a compressible cylindrical element 104. Furthermore, the bias member 92 need not be disposed around the valve stem 36 and between the proximal shoulder 96 of the sleeve 76 and the proximal region 98 of the valve stem 36.

Figure 10:
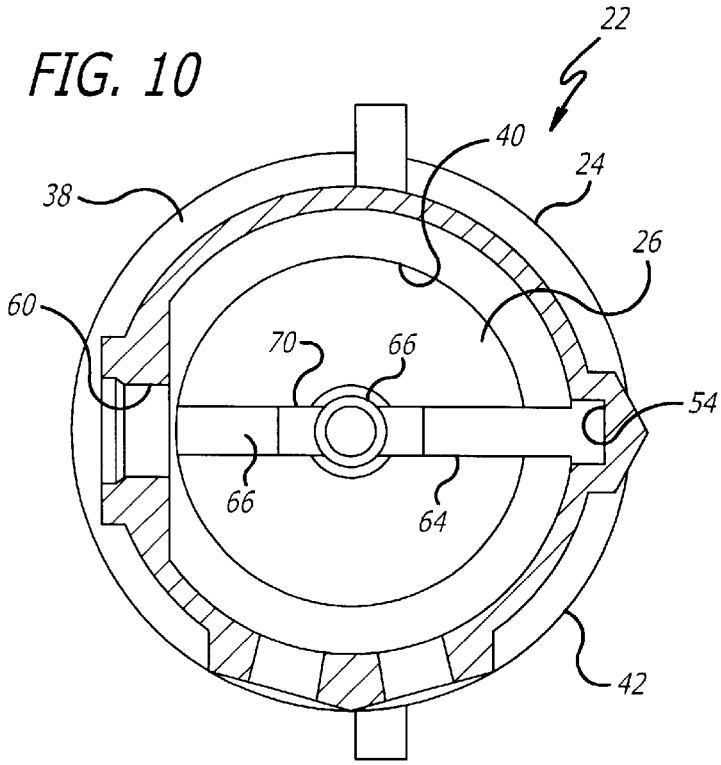
FIG. 10 is a plan top view of the nozzle body shown in FIG. 8.
Figure 11:
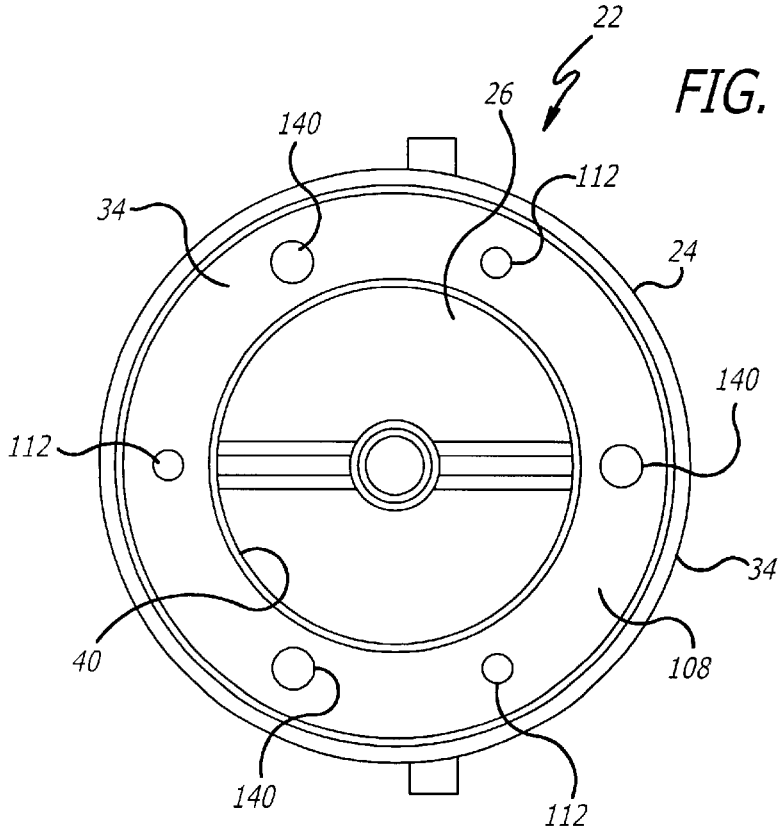
FIG. 11 is a plan bottom view of the nozzle body shown in FIG. 8.

Referring back FIGS. 10 and 11, the cradle 64, web 72, sleeve 76 and valve stem 36 are positioned underneath the crankshaft 30 to maximize the cross-sectional flow path of the fuel, and thus, promoting maximum fuel flow capabilities.

Referring back to FIGS. 1, 7, 11 and 15, three locating pins 106 extend outwardly from the base 108 of the nozzle body 22. The locating pins 106 have a cylindrical portion 110 which is threaded into circular-shaped holes 112 provided in the base 108 of the nozzle body 22 and a square-shaped cross-sectional portion 114 which extends outwardly. Of particular note is that existing fuel nozzles on the market today have round pins which tend to wear the flat engaging surfaces 7 of the rectangular-shaped indexing slots 6 of the fueling adapter 2 into a more oval shape slot. One of the disadvantages of forming an oval shape indexing slot is that the fuel nozzle may no longer be held in the correct position when the collar assembly is being rotated relative to the nozzle body during both connection and disconnection with the fueling adapter 2. In the worst condition, the fuel nozzle may be removed from a worn fueling adapter 2 with the interlock feature defeated which would subsequently allow the fuel nozzle to be opened when not connected to the fueling adapter. This may result in a dangerous spill of jet fuel.

The square-shaped locating pins 106 overcome this problem by having the flat sides 120 closely and accurately interfacing with the respective flat engaging surfaces 7 of the indexing slots 6, even when there is little left of the flat engaging surfaces 7 of a worn fueling adapter. It should be noted that the locating pins may have other cross-sectional shapes other than a square such as a rectangular-shaped locating pin as long as the flat sides are sufficiently large to contact the entire flat engaging surfaces 7 of the indexing slots 6 of the fueling adapter 2.

Figure 2:
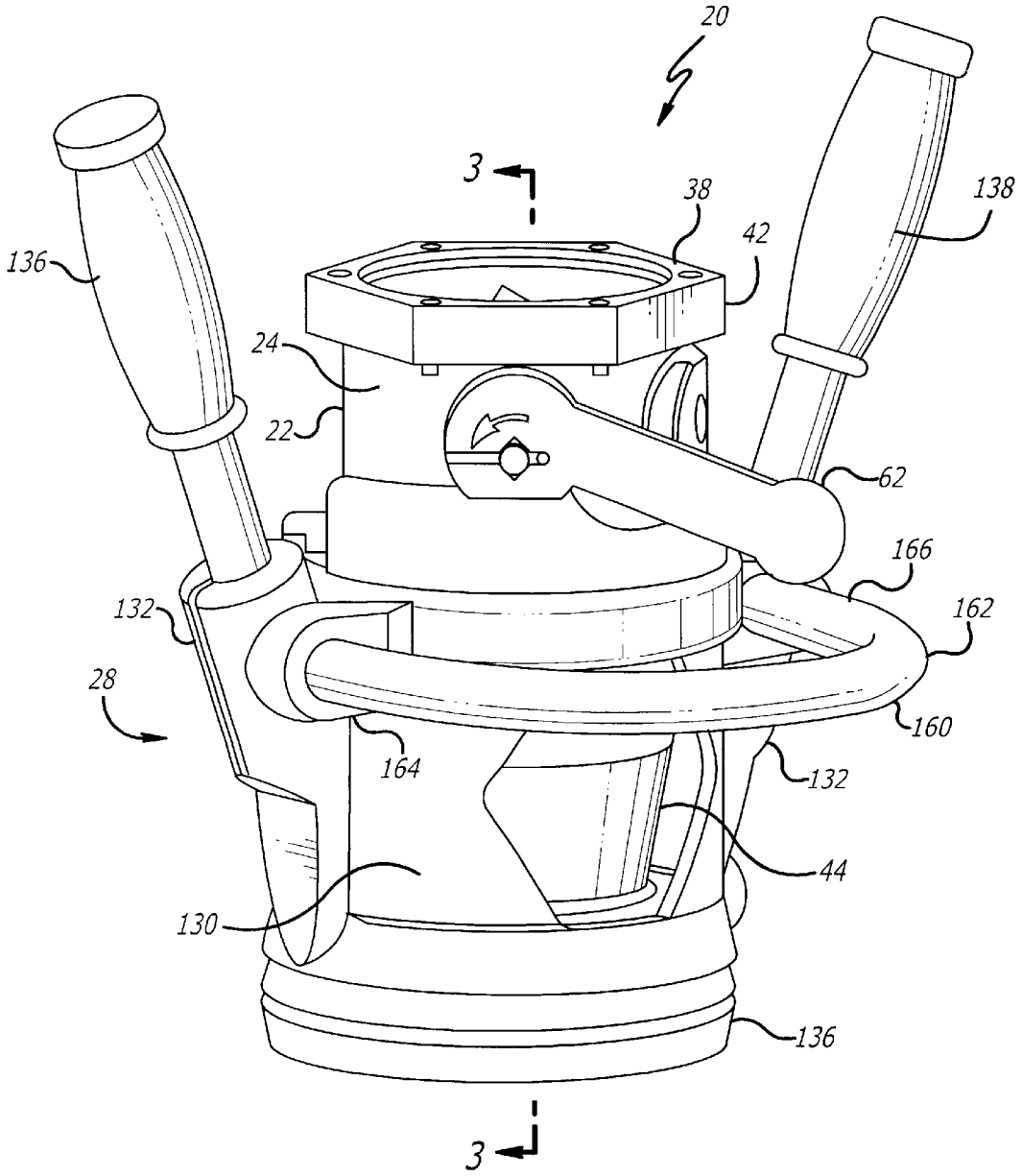
FIG. 2 is a perspective view of the fuel servicing nozzle which mates with the standardized fueling adapter shown in FIG. 1.

Referring to FIGS. 2 and 3, the collar assembly 28 includes a main portion 130 having a generally cylindrical shape which is larger in diameter than the exterior of the nozzle body 22 and surrounds the nozzle body 22, a first flange portion 132 extending radially outwardly from the main portion 130, and a second flange portion 134 extending radially outwardly from the main portion 130 and offset about 180 degrees from the first flange portion 132. Each flange portion 132, 134 accepts an upwardly extending handle 136, 138 used by the operator to manipulate the fuel nozzle 20. The collar assembly 28 is rotatably supported upon the underlying outer surface 24 of the nozzle body 22 and is maintained in its position by a plurality of ball bearings 140 such that the collar assembly 28 may be rotated with respect to the nozzle body 22. The collar assembly 28 further supports a resilient bumper 136 which encircles the distal portion of the collar assembly 28.

Referring to FIGS. 15–17 and 18A–18B, a portion of a safety interlock is shown. The base 108 of the nozzle body 22 receives a spring loaded interlock plate 138. The interlock plate 138 is biased toward the exterior of the nozzle body 22 toward the aircraft connection end by three equally spaced springs 140. The three locating pins 106 are equally positioned around the nose seal 88 and protrude through slots 142 of the interlock plate 138. The interlock plate 138 forms a mechanical interference between the three locating pins 106 to prevent rotation of the interlock plate 138 relative to the nozzle body 22. A bayonet ring 144 extends inwardly from the interior surface 146 of the collar assembly 28 and comprises a ring 148 separated by three gaps 150, and these gaps 150 accept the lock tabs 8 of the fueling adapter 2. The bayonet ring 144 further includes three interlock stops 152 which extend outwardly from an inner face 154 of the bayonet ring 144. When the fuel nozzle 20 is not coupled to the fueling adapter 2, an outer face 156 of the interlock plate 124 is pushed against the inner face 154 of the bayonet ring 144. Rotation of the collar assembly 28 relative to the nozzle body 22 is prevented by three engagement surfaces 158 of the interlock plate 138 abutting against the three interlock stops 152.

In order to increase the service life of the fuel nozzle 20, the bayonet ring 122 is formed from a relatively strong material such as stainless steel to withstand the repeated connections/disconnections with the fueling adapter 40. In the exemplary embodiment shown in the drawings, the bayonet ring 144 is embedded in the collar assembly 28 during the casting of the collar assembly 28. When using the lost wax casting method, the bayonet ring is embedded in a wax pattern of the collar assembly. The wax pattern and bayonet ring are then invested and molten aluminum is poured into a mold containing the bayonet ring 144. Thus, the collar assembly 28 is relatively light because it is formed predominantly from aluminum while the bayonet ring 144 sufficiently hard for superior wear resistance.

Referring to FIG. 2, a guard bar 160 is connected to the collar assembly 28. The guard bar 160 comprises a horseshoe shaped rod 162 with a first end 164 attached to the first flange portion 132 and a second end 166 attached to the second flange portion 134. Each of the flange portions 132, 134 includes a circular recess 168 which accepts the ends 164, 166 of the guard bar 160, and the guard bar 160 is securely attached by bolts 170.

To connect the fuel nozzle 20 to the fueling adapter 2 of the aircraft, the operator aligns the three locating pins 106 with the three indexing slots 6 of the fueling adapter 2. The lock tabs 8 of the fueling adapter 2 also align with the corresponding gaps 152 formed in the bayonet ring 144. This positioned relationship is maintained by the interlock plate 138. The interlock plate 138 establishes the locking rotational relationship between the three locating pins 106 and the three gaps 150 of the bayonet ring 144 through which the three lugs 8 of the fueling adapter 2 pass during connection. When properly aligned, the nozzle body 22 can be pushed onto the fueling adapter 2, thereby depressing the interlock plate 138. The depression of the interlock plate 138 causes engagement surfaces 158 of the interlock plate 138 to clear the interlock stops 152 of the bayonet ring 144. The collar assembly 28 can be rotated clockwise with respect to the fueling adapter 2, perfecting a bayonet style connection between the collar assembly 28 and fueling adapter 2.

In addition, the rotation of the collar assembly 28 releases the safety interlock operative upon the valve operating handle 62. The release of this mechanical interlock allows counterclockwise rotation of the valve operating handle 62 which in turn utilizes linkage to drive the valve stem 36 downwardly such that the flow control poppet valve 32 is pushed away from the nose seal 88 to allow fuel to flow through the fuel nozzle 20 and into the aircraft. Once refueling is complete, the operator rotates the valve operating handle 62 to the clockwise position shown in FIG. 2 which in turn draws the flow control poppet valve 32 against the nose seal 88 and completing the closure of the fuel nozzle 20 and precluding further fuel flow. With the valve operating handle 62 returned to the closed position, the collar assembly 28 is rotated with respect to the nozzle body 22 to release engagement of the fuel nozzle 20.

Figure 21:
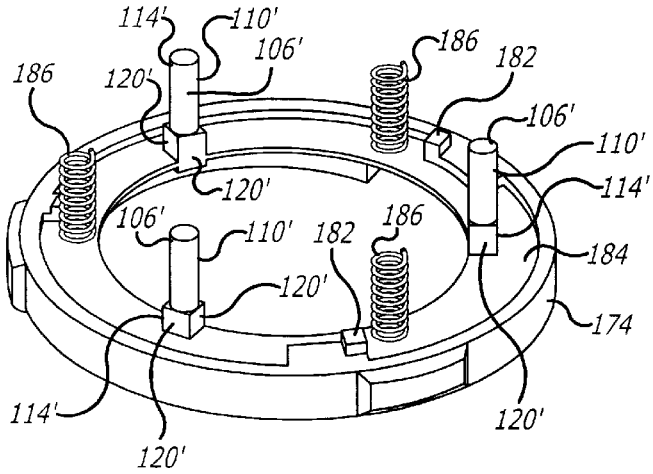
FIG. 21 is a perspective view illustrating a portion of the back-up safety interlock of the fuel servicing nozzle of FIG. 19.
Figure 22:
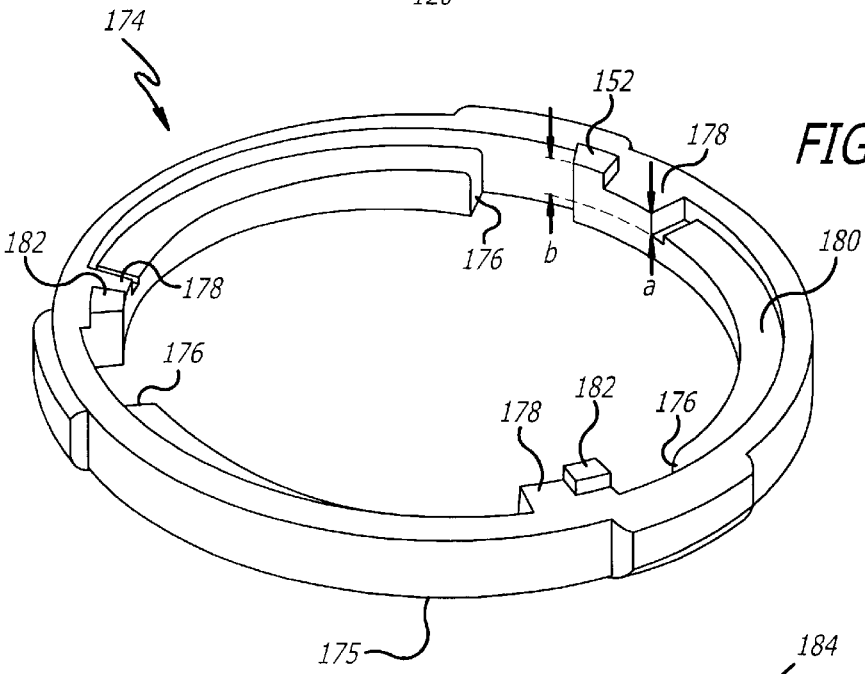
FIG. 22 is a perspective view illustrating a bayonet ring of the fuel servicing nozzle of FIG. 19.
Figure 23:
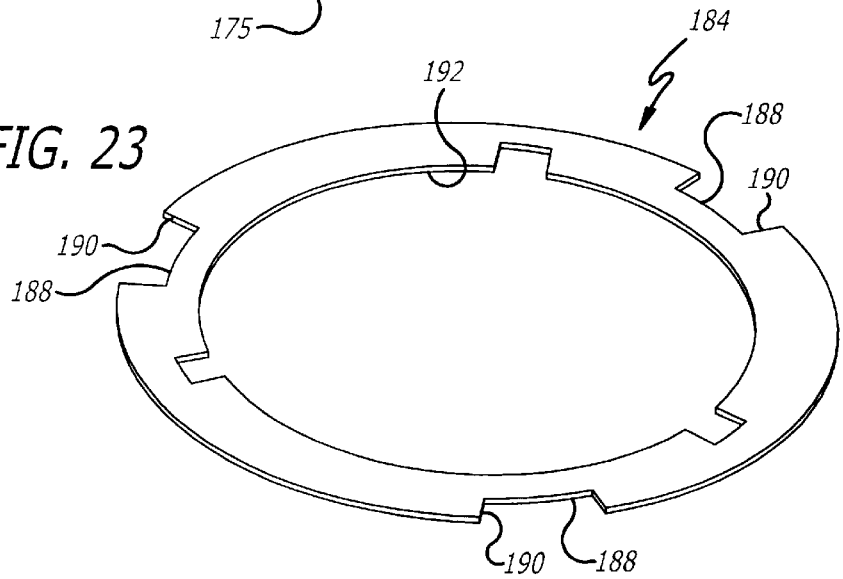
FIG. 23 is a perspective view illustrating an interlock plate of the fuel servicing nozzle of FIG. 19.

Referring to FIGS. 19–23 and 24A–24C, another embodiment of a fuel servicing nozzle 172 according to the present invention is shown which is similar to the prior embodiment and further includes a back-up safety interlock. Those elements considered unique are discussed in detail, and similar elements are numbered with the same number and with a prime. A distal end of a collar assembly 28 includes a bayonet ring 174 having a ring 175 separated by three gaps 176, wherein the gaps 176 accept the lock tabs 8 of the fueling adapter 2. As best shown in FIG. 22, three primary stops 178, which are spaced at about 120 degree intervals, extend outwardly a distance a from an inner face 180 of the bayonet ring 174. Adjacent to each of the primary stops 178 are secondary stops 182 which extend outwardly a distance b from the inner face 180 of the bayonet ring 174, wherein the distance a is less than the distance b. As best shown in FIGS. 21 and 23, an interlock plate 184 is biased towards the inner face 180 of the bayonet ring 174 by springs 186. The interlock plate 184 includes three slots 188, and each of the slots 188 has an engagement surface 190 which abuts with the primary 178 and secondary stops 182.

Figure 24A:
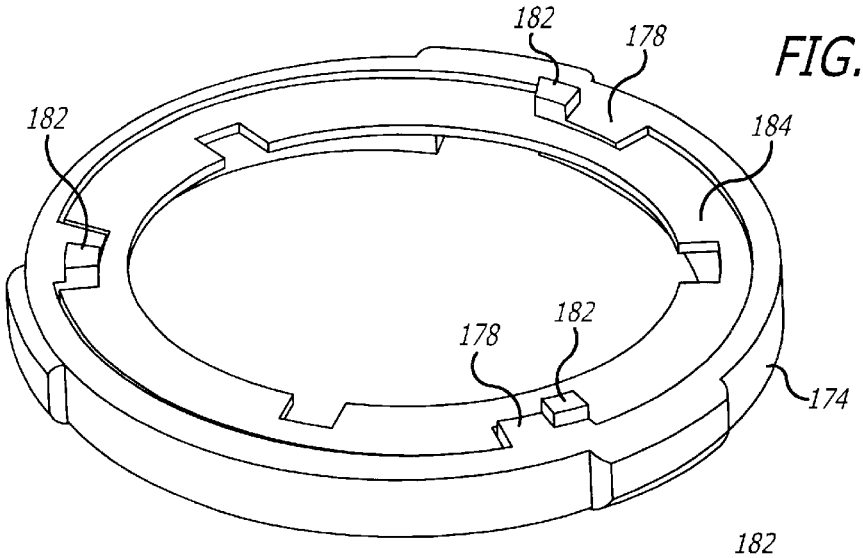
FIGS. 24A–24C are perspective views illustrating various positions of the interlock plate relative to the bayonet ring for the fuel servicing nozzle of FIG. 19.
Figure 24B:
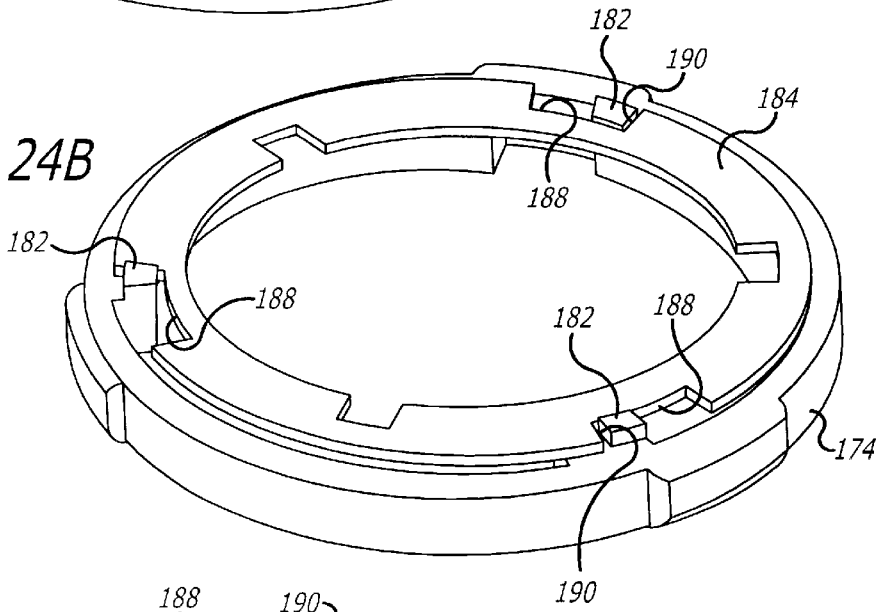

When the fuel servicing nozzle 201 is not coupled to the fueling adapter 2, an outer face 192 of the interlock plate 184 is pushed against an inner face 180 of the bayonet ring 174, and the primary stops 178 and secondary stops 182 are disposed within the slots 188 as shown in FIG. 24A. Rotation of the collar assembly 28' relative to the nozzle body (not shown) is prevented by the engagement surfaces 190 of the interlock plate 184 abutting against the primary stops 178. When the fuel nozzle 172 is aligned, it can be pushed into the fueling adapter 2. The lock tabs 8 of the fueling adapter 2 push the interlock plate 184 away from the inner face 180 of the bayonet ring 174 a distance greater than a to clear the primary stops 178 as shown in FIG. 24B. The collar assembly 28' is free to partially rotate about the nozzle body (not shown) and fueling adapter 2 to the extent where the engagement surfaces 190 of the interlock plate 184 abut against the secondary stops 182. To prevent the engagement surfaces 190 of the interlock plate 184 from scuffing or binding against the primary stops 178 of the bayonet ring 174, the distance a of the primary stops 178 is less than the full available travel of the interlock plate 184. In other words, the thickness of the lock tabs 8 is greater than the distance a of the primary stops 178. Consequently, only partial depression of the interlock plate 174 is required to clear the primary stops 178 and to partially rotate the collar assembly 281 to a partially secured position.

Figure 24C:
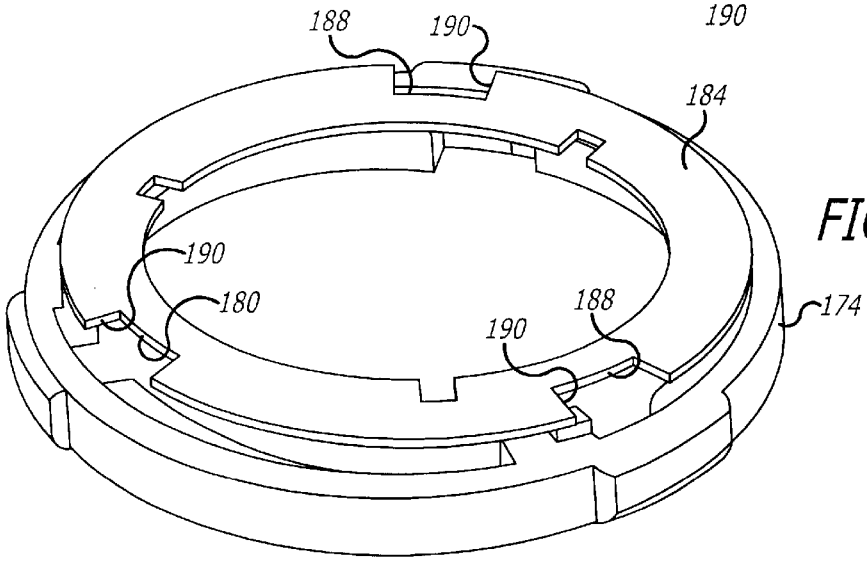

The collar assembly 28' may be rotated to the fully secured position by fully pushing the fuel nozzle 172 onto the fueling adapter 2 such that the interlock plate 174 is separated by the inner surface 180 of the bayonet ring 174 by a distance slightly greater than b to clear the secondary stops 182 as shown in FIG. 24C. Thus, anything other than a full depression of the interlock plate 174 by a fully engaged fueling adapter 2 will result in the secondary stops 182 preventing complete rotation of the collar assembly 28' and rotation of the operating handle (not shown) to open the flow control poppet valve (not shown).

Although the present invention has been described in detail with regarding the exemplary embodiments and drawings thereof, it should be apparent to those skilled in the art that various adaptations may be accomplished without departing from the spirit and scope of the invention. Accordingly, the invention is not limited to the precise embodiment shown in the drawings and described in detail hereinabove.

What is claimed is:

1. A fuel servicing nozzle for mating with a fueling adapter having an adapter valve biased towards: a closed position to prevent fuel flow, said fuel servicing nozzle comprising:

a nozzle body defining an: interior passage;

a crankshaft extending transversely across the entire diameter of said interior passage of said nozzle;

a web having a generally flat wall extending radially outwardly with sides contacting a sidewall of said interior passage;

a cradle formed on top of said web and being supported by said web, said cradle supporting said crankshaft;

a nozzle valve coupled to said nozzle body and in communication with said crankshaft, said nozzle valve movable between a fully retracted position and a fully extended position, said nozzle valve sealing fuel flow when in said fully retracted position and allowing fuel flow when in said fully extended position; and a bias member operably coupled to said nozzle valve and adapted to maintain said nozzle valve in said fully extended position.

2. The fuel nozzle of claim 1, wherein said bias member maintains said nozzle valve in said fully extended position when intimate contact between said nozzle valve and said adapter valve is disrupted.

3. The fuel nozzle of claim 2, wherein said intimate contact is established when said nozzle valve abuts against said adapter valve and pushes said adapter valve in the downstream direction, and wherein said intimate contact between said nozzle valve and said adapter valve is disrupted when fuel flow forces said adapter valve to move further in the downstream direction such that said nozzle valve no longer abuts said adapter valve.

4. The fuel nozzle of claim 3, wherein said adapter valve moves further in the downstream direction such that said nozzle valve no longer abuts said adapter valve during relatively high fuel flow rates.

5. The fuel nozzle of claim 2, further comprising an operating handle coupled to said nozzle valve such that rotation of said operating handle moves said nozzle valve to said fully retracted position and said fully extended position.

6. The fuel nozzle of claim 5, wherein said bias member is a spring.

7. The fuel nozzle of claim 6, wherein said spring is a wave spring.

8. The fuel nozzle of claim 6, wherein said spring is a coil spring.

9. The fuel nozzle of claim 5, wherein said bias member is an o-ring.

10. The fuel nozzle of claim 5, wherein said bias member is a compressible material which exerts force when compressed.

11. The fuel nozzle of claim 5, further comprising:

a valve stem connected to said nozzle valve at a distal region and coupled to said operating handle at a proximal region; and a sleeve disposed around said valve stem and having a proximal region and distal region, said sleeve guiding said valve stem;

said bias member disposed between said proximal region of said sleeve and said distal region of said valve stem when said nozzle valve is in said fully extended position.

12. The fuel nozzle of claim 5, further comprising:

a valve stem connected to said nozzle valve at a distal region and coupled to said operating handle at a proximal region; and a sleeve disposed around said valve stem and having a proximal region and a distal region, said sleeve guiding said valve stem;

said bias member compressed between said proximal region of said sleeve and said distal region of said valve stem when said nozzle valve is in said fully extended position.

13. The fuel nozzle of claim 12, further comprising said valve stem connected to said crankshaft at said proximal region and adapted to push said nozzle valve into said fueling adapter, thereby opening a delivery flow path.

14. The fuel nozzle of claim 1, wherein said cradle includes a top portion shaped to conform to the diameter of the said crankshaft, and a center portion being interrupted to allow for rotation of said crank arm of said crankshaft.

15. The fuel nozzle of claim 14, wherein said nozzle valve and said adapter valve are poppet valves.

16. A fuel servicing nozzle for mating with a fueling adapter having an adapter valve biased towards a closed position to prevent fuel flow, said fuel servicing nozzle comprising:

a nozzle body defining an interior passage;

a crankshaft extending transversely across the entire diameter of said interior passage of said nozzle;

a web having a generally flat wall extending radially outwardly with sides contacting a sidewall of said interior passage;

a cradle formed on top of said web and being supported by said web, said cradle supporting said crankshaft;

a nozzle poppet valve coupled to said nozzle body and in communication with said crankshaft, said nozzle valve for sealing fuel flow when at a fully closed position and allowing fuel flow when at a fully open position;

wherein said nozzle valve pushes said adapter valve in an open direction when said fuel nozzle is coupled to said fueling adapter and moved to said fully open position; and wherein intimate contact between said adapter valve and said nozzle valve is maintained by said adapter valve being biased in the closed direction such that said adapter valve directs an upstream directed force onto said nozzle valve;

wherein said upstream directed force onto said nozzle valve maintains said nozzle valve in said fully open position;

a bias member coupled to said nozzle valve and adapted to maintain said nozzle valve in said fully open position when said intimate contact between said adapter valve and said nozzle valve is disrupted and when said adapter valve is no longer able to direct said upstream directed force onto said nozzle valve.

17. The fuel nozzle of claim 16, wherein said bias member is a spring.

18. The fuel nozzle of claim 17, further comprising:

a valve stem coupled to said nozzle valve at a distal region and coupled to said crankshaft at proximal region;

wherein rotation of said crankshaft causes said crankshaft to translate a rotating motion to an axial motion of said valve stem; and wherein said crankshaft rotates to "past bottom dead center" when said nozzle valve is at said fully open position, wherein said crankshaft is biased to remain at "past bottom dead center" by said bias member.

19. The fuel nozzle of claim 18, further comprising:

a sleeve disposed around said valve stem and having a proximal portion and a distal portion, said sleeve guiding said valve stem;

said bias member disposed between said proximal portion of said sleeve and said proximal portion of said valve stem; and said bias member being compressed when said nozzle valve is at said fully open position such that said bias member directs an upstream directed force onto said nozzle valve.

20. The fuel nozzle of claim 18, further comprising:

a sleeve disposed around said valve stem and having a proximal portion and a distal portion, said sleeve guiding said valve stem;

wherein a first end of said bias member abuts against said proximal portion of said sleeve and a second end of said bias member abuts a proximal portion of said valve stem when said nozzle valve is at said fully open position.

21. The fuel nozzle of claim 18, further comprising:

a nose seal disposed at a distal region of said nozzle body, said nose seal forming a fuel seal when compressed by said nozzle valve;

wherein said crankshaft rotates to "past top dead center" when said nozzle valve is at said fully closed position, wherein said crankshaft is biased to remain at "past top dead center" by said nose seal; and wherein said nose seal is compressed when said nozzle valve is at said fully closed position such that said nose seal directs a downstream directed force onto said nozzle valve.

22. The fuel nozzle of claim 21, wherein "past bottom dead center" and "past top dead center" are the limits of rotation of said crankshaft, and wherein total rotation of said crankshaft is about 210 degrees.

23. A fuel servicing nozzle for mating with a fueling adapter having a plurality of indexing slots and a plurality of radially extending lock tabs, said fuel nozzle comprising:

a nozzle body;

a collar assembly rotatably coupled to said nozzle body, said collar assembly having a proximal region and a distal region;

a first member disposed at said distal region of said collar assembly, said member having an inner face and an outer face;

at least one primary interlock stop extending outwardly at a distance a from said inner face of said member;

at least one secondary interlock stop extending outwardly at a distance b from said inner face of said member;

wherein a is less than b; and a second member biased towards said inner face of said first member, said second member having at least one engagement surface adapted to engage with said at least one primary interlock stop and said at least one secondary interlock stop;

wherein said second member prevents initial rotation of said collar assembly about said nozzle body when said at least one engagement surface abuts said at least one primary interlock stop; and wherein said interlock plate prevents final rotation of said collar assembly about said nozzle body when said at least one engagement surface abuts said at least one secondary interlock stop.

24. The fuel nozzle of claim 23, wherein said first member is a bayonet ring and said second member is an interlock plate.

25. The fuel nozzle of claim 24, wherein said interlock plate is adapted to allow initial rotation of-said collar assembly about said nozzle body when said lock tabs push said interlock plate away from said inner face of said bayonet ring at a distance between a and b, and wherein said interlock plate is adapted to allow final rotation of said collar assembly about said nozzle body when said lock tabs push said interlock plate away from said inner face of said bayonet ring at a distance greater than b.

26. The fuel nozzle of claim 25, wherein said at least one primary interlock stop is disposed adjacent to said secondary interlock stop.

27. A fuel servicing nozzle for mating with a fueling adapter having a plurality of indexing slots and a plurality of radially extending lock tabs, said fuel nozzle comprising:

a nozzle body having an outer surface and an interior passage; and a collar assembly rotatably coupled to said nozzle body wherein said collar assembly is adapted to form a first mechanical interference to prevent initial rotation of said collar assembly about said nozzle body;

wherein said collar assembly is adapted to form a second mechanical interference to prevent final rotation of said collar assembly about said nozzle body;

wherein said second mechanical interference requires a greater clearance than said first mechanical clearance.

28. The fuel nozzle of claim 27, further comprising:

a member disposed at a distal region of said collar assembly;

wherein said first mechanical interference including a first stop extending outwardly at a distance a from said inner face of said member;

wherein said second mechanical interference including a second stop extending outwardly at a distance b from said inner face of said member;

wherein b is greater than a.

29. The fuel nozzle of claim 27, further comprising:

another member rotatively coupled to said member;

said another member including an engagement surface for abutting against said first mechanical interference and said second mechanical interference.

30. The fuel nozzle of claim 29, wherein said member is a bayonet ring and said another member is an interlock plate.

31. A method of mating a fuel servicing nozzle to a fueling adapter having a plurality of radially extending lock tabs, comprising:

providing a nozzle body and a collar assembly, wherein the collar assembly is rotatively coupled to the nozzle body;

preventing initial rotation of the collar assembly about the nozzle body and fueling adapter by providing a first stop which engages with a member, wherein the first stop is cleared by positioning the fuel nozzle onto the fueling adapter such that the lock tabs drive the member a distance a away from the first stop; and preventing final rotation of said collar assembly about the nozzle body and fueling adapter by providing a second stop which engages the member, wherein the second stop is cleared by further positioning the fuel nozzle onto the fueling adapter such that the lock tabs drive the member a distance b away from the second stop;

wherein b is greater than a.

32. A method to prevent fuel flow when a fuel servicing nozzle is mated to an unsafe fueling adapter with worn lock tabs, comprising:

providing a nozzle body and a collar assembly, wherein the collar assembly is rotatively coupled to the nozzle body;

preventing initial rotation of the collar assembly about the nozzle body and fueling adapter by providing a first stop which engages with a member, wherein the first stop is cleared by positioning the fuel nozzle onto. the fueling adapter such that lock tabs drive the member a distance a away from the first stop; and preventing final rotation of said collar assembly about the nozzle body and fueling adapter by providing a second stop which engages the member, wherein the second stop is cleared by further positioning the fuel nozzle onto the fueling adapter such that lock tabs drive the member a distance b away from the second stop;

wherein b is greater than a;

wherein unworn lock tabs are capable of clearing the first stop and the second stop; and wherein worn lock tabs are capable of clearing the first stop but incapable of clearing the second stop.

33. A method of mating a fuel servicing nozzle to a fueling adapter having an adapter valve biased towards a closed position to prevent fuel flow, comprising:

providing the fuel nozzle defining an interior passage and having a crankshaft traversing the entire diameter of said interior passage, the fuel nozzle having a nozzle valve in communication with the crankshaft adapted to prevent fuel flow when in a fully retracted position and allow fuel flow when in an extended position;

coupling the fuel nozzle to the fueling adapter;

positioning the nozzle valve in a fully extended position such that the nozzle valve abuts the adapter valve and pushes the adapter valve in a downstream direction; and actuating the crankshaft to bias the nozzle valve in a fully extended position with a bias member when intimate contact between the nozzle valve and adapter valve is disrupted.

34. The method of claim 33, wherein intimated contact between the nozzle valve and adapter valve is disrupted when fuel flow forces the adapter valve further in a downstream direction such that the adapter valve is no longer in contact with the nozzle valve.

35. The method of claim 33, further comprising:

providing the fuel nozzle with a valve stem, wherein the valve stem is coupled to the crankshaft at a proximal region and to the nozzle valve at a distal region;

providing a sleeve around the valve stem to guide the valve stem, wherein the sleeve has a proximal region and a distal region;

wherein said step of providing the fuel nozzle with a bias member includes disposing the bias member between the proximal region of the sleeve and the distal region of the valve stem.

36. The method of claim 35, wherein a distal region of the bias member abuts the proximal region of the valve stem and a proximal region of the bias member abuts the proximal region of the sleeve when the nozzle valve is in the fully extended position.

37. The method of claim 35, wherein the bias member is compressed between the proximal region of the of the valve stem and the proximal region of the sleeve when the nozzle valve is in the fully extended position such that the bias member directs an upstream directed force onto the nozzle valve.

38. The method of claim 37, wherein the nozzle valve and adapter valve are poppet valves.

* * * * *